US009053656B2

(12) United States Patent
Horikoshi et al.

(10) Patent No.: US 9,053,656 B2
(45) Date of Patent: Jun. 9, 2015

(54) APPARATUS FOR EVALUATING OPTICAL PROPERTIES OF THREE-DIMENSIONAL DISPLAY, AND METHOD FOR EVALUATING OPTICAL PROPERTIES OF THREE-DIMENSIONAL DISPLAY

(75) Inventors: Tsutomu Horikoshi, Kamakura (JP); Masashi Tsuboi, Yokosuka (JP); Shinji Kimura, Tokyo (JP)

(73) Assignee: NTT DOCOMO, INC., Tokyo (JP)

( * ) Notice: Subject to any disclaimer, the term of this patent is extended or adjusted under 35 U.S.C. 154(b) by 708 days.

(21) Appl. No.: 13/378,472

(22) PCT Filed: Jun. 14, 2010

(86) PCT No.: PCT/JP2010/060053
§ 371 (c)(1),
(2), (4) Date: Feb. 29, 2012

(87) PCT Pub. No.: WO2010/147089
PCT Pub. Date: Dec. 23, 2010

(65) Prior Publication Data

US 2012/0154394 A1 Jun. 21, 2012

(30) Foreign Application Priority Data

| | | |
|---|---|---|
| Jun. 15, 2009 | (JP) | 2009-142578 |
| Sep. 8, 2009 | (JP) | 2009-207452 |
| May 20, 2010 | (JP) | 2010-116366 |

(51) Int. Cl.
*G09G 3/00* (2006.01)

(52) U.S. Cl.
CPC ..... *G09G 3/006* (2013.01); *G09G 3/003* (2013.01); *G09G 2320/0209* (2013.01); *G09G 2360/145* (2013.01); *G09G 2360/16* (2013.01)

(58) Field of Classification Search
CPC ... G09G 3/003; G09G 3/006; G09G 2360/16; G09G 2360/145; G09G 2320/0209
USPC ..... 345/419
See application file for complete search history.

(56) References Cited

U.S. PATENT DOCUMENTS

| | | | | |
|---|---|---|---|---|
| 5,991,073 | A | 11/1999 | Woodgate et al. | |
| 6,198,484 | B1 * | 3/2001 | Kameyama | 345/419 |

(Continued)

FOREIGN PATENT DOCUMENTS

| | | |
|---|---|---|
| JP | 7 120852 | 5/1995 |
| JP | 9 205661 | 8/1997 |
| JP | 2008 015188 | 1/2008 |

OTHER PUBLICATIONS

Combined Office Action and Search Report issued Oct. 17, 2013 in Chinese Patent Application No. 201080026456.5 (with English translation).

(Continued)

*Primary Examiner* — Dave Czekaj
*Assistant Examiner* — Berteau Joisil
(74) *Attorney, Agent, or Firm* — Oblon, McClelland, Maier & Neustadt, L.L.P.

(57) ABSTRACT

An interocular luminance analyzing unit analyzes luminance perceived between eyes of an observer based on a luminance distribution image, thereby generating a stereoscopy determination image, a stereoscopy determining unit determines a stereoscopy possible region based on this stereoscopy determination image. This is applicable irrespective of the kind of 3D displays including the two-view type, the multi-view type, and the integral type. Therefore, with the apparatus for evaluating optical properties of a 3D display and the method for evaluating optical properties of a 3D display, the evaluation of optical properties can be performed independently of the kind of 3D displays.

19 Claims, 18 Drawing Sheets

(56) References Cited

U.S. PATENT DOCUMENTS

2006/0268104 A1* 11/2006 Cowan et al. ..... 348/42
2008/0007511 A1 1/2008 Tsuboi et al.

OTHER PUBLICATIONS

Taira, K., "Variation of Autostereoscopic Displays and Their Evaluation," ITE Technical Report, vol. 33, No. 16, pp. 13-17, (Mar. 17, 2009) (with English abstract).

Boner, P. M., et al., "A new way to characterize auto-stereoscopic 3D displays using Fourier optics instrument," EI09, Total 12 Pages, (2009).

Taira, K., et al., "Variation of Autostereoscopic Displays and Their Measurement," IDW'08 3D2-2, pp. 1103-1106, (2008).

Leroux, T., et al., "VCMaster3D: A New Fourier Optics Viewing Angle Instrument for Characterization of Autostereoscopic 3D Displays," SID 09 Digest, pp. 115-118, (2009).

Uehara, S., et al., "Methodology of Optical Measurement for Autostereoscopic Displays," IDW'08, pp. 1107-1110, (2008).

International Search Report Issued Sep. 7, 2010 in PCT/JP10/060053 Filed Jun. 14, 2010.

International Preliminary Report on Patentability Issued Jan. 17, 2012 in PCT/JP10/060053 Filed Jun. 14, 2010.

* cited by examiner (A)

(B)

APPARATUS FOR EVALUATING OPTICAL PROPERTIES OF THREE-DIMENSIONAL DISPLAY, AND METHOD FOR EVALUATING OPTICAL PROPERTIES OF THREE-DIMENSIONAL DISPLAY

TECHNICAL FIELD

The present invention relates to an apparatus for evaluating optical properties of a three-dimensional display and a method for evaluating optical properties of a three-dimensional display.

BACKGROUND ART

In order to evaluate optical properties of a three-dimensional display (hereinafter also referred to as a "3D display"), it is known to measure a distribution state of light rays radiated, for example, from a number of points of measurement on the 3D display using a scope or the like. Specifically, a method of measuring a luminance distribution in a radiation angle direction from a measurement point is common.

Now, whether an observer perceives a stereoscopic image is important for 3D displays, and it is therefore necessary not only to measure physical distributions of light rays from 3D displays but also to evaluate whether a person can perceive a stereoscopic effect. In other words, whether light is precisely projected onto the observer's eyes is one of criteria for evaluating optical properties of 3D displays. Therefore, in evaluating optical properties of 3D displays, whether images corresponding to the observer's left and right eyes can be viewed as clear images is one of the points. In general, it is difficult to completely separate lights that should enter the left and right eyes from each other, so that undesired light enters the eyes as leaked light (crosstalk). In other words, leaked light of an image that naturally should not be seen enters the observer's eye as crosstalk. The amount of crosstalk affects the quality of stereoscopic perception. Therefore, the optical properties of a 3D display can be evaluated based on the luminance contrast between desired light and undesired light entering each of the left and right eyes, as the determination as to whether a stereoscopy can be perceived without contradiction. For example, in the technique described in Non Patent Literature 1, a method of evaluating optical properties of a 3D display using the product of 3D contrasts of the left and right eyes is proposed.

For example, as described in Non Patent Literature 2, a variety of methods including the two-view type, the multi-view type, and the integral type are proposed for 3D displays. In the two-view or the multi-view type 3D displays, the optical properties of 3D displays can be evaluated based on the above-noted 3D contrast since images for the right eye and for the left eye are determined beforehand.

CITATION LIST

Non Patent Literature

Non Patent Literature 1: Pierre M. Boher, Thibault Bignon, Thierry R. Leroux, "A new way to characterize auto-stereoscopic 3D displays using Fourier optics instrument," EI09, 7237-37 (2009)

Non Patent Literature 2: Taira K., Hamagishi G, Izumi K., Uehara S., Nomura T., Mashitani K., Miyazawa A., Koike T., Yuuki A., Horikoshi T., Hisatake Y., Ujike H. and Nakano Y., "Variation of Autostereoscopic displays and their measurements," IDWO8, 3D2-2, 1103-1106 (2008)

SUMMARY OF INVENTION

Technical Problem

However, in the case of the integral type 3D display, different from the two-view or multi-view type, the concept of viewpoint does not exist. That is, the integral type 3D display is a 3D display that does not have the idea of images for the left and right eyes but aims to faithfully reproduce light rays radiating from an object. Therefore, the conventional 3D contrast cannot be applied when optical properties of the integral type 3D display are evaluated.

The present invention is made in view of the foregoing problem and aims to provide an apparatus for evaluating optical properties of a 3D display and a method for evaluating optical properties of a 3D display, which allows an evaluation of optical properties independently of the kind of 3D displays.

Solution to Problem

In order to solve the aforementioned problem, an apparatus for evaluating optical properties of a three-dimensional display in the present invention includes luminance measuring means for measuring a luminance in a radiation angle direction of a light ray radiated from a predetermined measurement point on the three-dimensional display, luminance distribution analyzing means for analyzing a luminance distribution state in the radiation angle direction of the light ray, based on luminance data measured by the luminance measuring means, and generating a luminance distribution image of the light ray, interocular luminance analyzing means for analyzing a luminance perceived between eyes of an observer, based on the luminance distribution image, and generating a stereoscopy determination image, and stereoscopy determining means for determining a certain region in the radiation angle direction in front of the three-dimensional display, as a stereoscopy possible region, based on the stereoscopy determination image.

A method for evaluating optical properties of a three-dimensional display in the present invention includes a luminance measuring step of, by luminance measuring means, measuring a luminance in a radiation angle direction of a light ray radiated from a predetermined measurement point on the three-dimensional display, a luminance distribution analyzing step of, by luminance distribution analyzing means, analyzing a luminance distribution state in the radiation angle direction of the light ray, based on luminance data measured by the luminance measuring means, and generating a luminance distribution image of the light ray, an interocular luminance analyzing step of, by interocular luminance analyzing means, analyzing a luminance perceived between eyes of an observer, based on the luminance distribution image, and generating a stereoscopy determining image, and a stereoscopy determination step of, by stereoscopy determining means, determining a certain region in the radiation angle direction in front of the three-dimensional display, as a stereoscopy possible region, based on the stereoscopy determination image.

In the apparatus for evaluating optical properties of a three-dimensional display and the method for evaluating optical properties of a three-dimensional display in this manner, after the interocular luminance analyzing means generates a stereoscopy determination image by analyzing the luminance perceived between the eyes of an observer based on the luminance distribution image, the stereoscopy determining means determines a stereoscopy possible region based on the stereoscopy determination image. This is applicable irrespective of the kind of 3D displays including the two-view type, the multi-view type, and the integral type. Therefore, with the apparatus for evaluating optical properties of a three-dimensional display and the method for evaluating optical properties of a three-dimensional display of the present invention, the evaluation of optical properties can be performed independently of the kind of three-dimensional displays.

Preferably, the luminance distribution analyzing means analyzes the luminance distribution state for each viewpoint and generates the luminance distribution image for each viewpoint, for all viewpoints of the three-dimensional display.

Since the luminance distribution image for each viewpoint is generated in this manner, the optical properties can be evaluated for all the viewpoints of the three-dimensional display.

Preferably, the interocular luminance analyzing means extracts two luminance distribution images corresponding to an interocular distance of the observer, from among the luminance distribution images for each viewpoint that are generated by the luminance distribution analyzing means, and analyzes a contrast ratio of luminance between the eyes of the observer using the extracted two luminance distribution images, thereby generating the stereoscopy determination image.

The two luminance distribution images corresponding to the interocular distance of the observer that are extracted from among the luminance distribution images for each viewpoint correspond to the right eye and the left eye, respectively, of the observer.

Preferably, the luminance distribution analyzing means analyzes the luminance distribution state for each line-of-sight direction and generates the luminance distribution image for each line-of-sight direction, for all line-of-sight directions of the three-dimensional display.

Since the luminance distribution image for each line-of-sight direction is generated in this manner, the optical properties can be evaluated in all the line-of-sight directions of the three-dimensional display.

Preferably, the interocular luminance analyzing means extracts two luminance distribution images corresponding to an interocular distance of the observer, from among the luminance distribution images for each line-of-sight direction that are generated by the luminance distribution analyzing means, and analyzes a contrast ratio of luminance between the eyes of the observer using the extracted two luminance distribution images, thereby generating the stereoscopy determination image.

The two luminance distribution images corresponding to the interocular distance of the observer that are extracted from among the luminance distribution images for each light-of-sight direction correspond to the right eye and the left eye, respectively, of the observer.

Preferably, the contrast ratio of luminance is a ratio between light that should enter and light that should not enter the right eye and the left eye of the observer.

In the present invention, preferably, the ratio between light that should enter and light that should not enter the right and left eyes of the observer is set as a criterion for evaluating the optical properties of the three-dimensional display.

Preferably, a value of the contrast ratio of luminance does not entail a sign change when light that should enter the right eye of the observer enters the right eye and light that should enter the left eye of the observer enters the left eye, whereas the value entails a sign change when light that should enter the right eye of the observer enters the left eye of the observer or when light that should enter the left eye of the observer enters the right eye of the observer.

According to the present invention, a value of the contrast ratio of luminance can be calculated in consideration of a pseudoscopic vision.

Preferably, the stereoscopy determining means determines the certain region that corresponds to a portion in which the contrast ratio of luminance exceeds a predetermined threshold in the stereoscopy determination image, as the stereoscopy possible region.

The determination as to whether a stereoscopy possible region or not can be made easily by setting an appropriate threshold.

Preferably, the luminance distribution image and the stereoscopy determination image are images indicating a luminance distribution in the region on a plane orthogonal to a display surface of the three-dimensional display.

In the present invention, the luminance distribution image and the stereoscopy determination image each correspond to a plane orthogonal to the display surface of the three-dimensional display, in particular, a plane horizontal to the ground in a case where the three-dimensional display is installed in a usual usage manner. Then, the stereoscopy determining means can make a determination as to whether it is a stereoscopy possible region or not, based on the stereoscopy determination image, for a region in front of the three-dimensional display in the radiation angle direction of a light ray radiated from the three-dimensional display in the case where the three-dimensional display is installed in a usual usage manner.

Advantageous Effects of Invention

The present invention provides an apparatus for evaluating optical properties of a three-dimensional display and a method for evaluating optical properties of a three-dimensional display, which allows an evaluation of optical properties independently of the kind of 3D displays.

DESCRIPTION OF EMBODIMENTS

Figure 1:
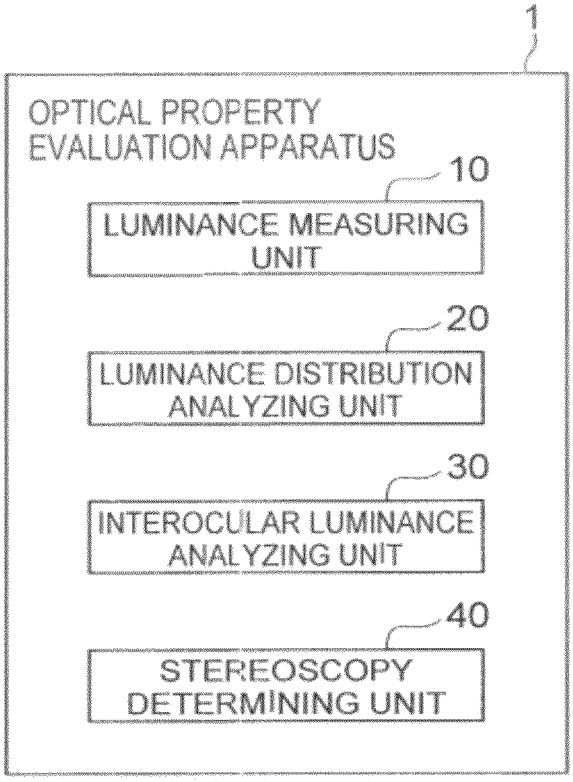
FIG. 1 is an overall configuration diagram of an optical property evaluation apparatus 1 according to a first embodiment.

In the following, suitable embodiments of an apparatus for evaluating optical properties of a three-dimensional display and a method for evaluating optical properties of a three-dimensional display according to the present invention will be described in detail with reference to the accompanying drawings. It is noted that the same elements are denoted by the same reference numerals in the description of the drawings, and an overlapping description will be omitted.

First Embodiment

Configuration of Optical Property Evaluation Apparatus 1

A configuration of an optical property evaluation apparatus 1 according to a first embodiment of the present invention will be described with reference to FIG. 1. FIG. 1 is an overall configuration diagram of the optical property evaluation apparatus 1. As shown in FIG. 1, the optical property evaluation apparatus 1 is configured to include, as functional components, a luminance measuring unit 10 (corresponding to the "luminance measuring means" in the claims), a luminance distribution analyzing unit 20 (corresponding to the "luminance distribution analyzing means" in the claims), an interocular luminance analyzing unit 30 (corresponding to the "interocular luminance analyzing means" in the claims), and a stereoscopy determining unit 40 (corresponding to the "stereoscopy determining means" in the claims).

The luminance measuring unit 10 measures a luminance in a radiation angle direction of a light ray radiated from a predetermined measurement point on a 3D display. The luminance distribution analyzing unit 20 analyzes a luminance distribution state in the radiation angle direction of the light ray, based on luminance data measured by the luminance measuring unit 10, and generates a luminance distribution image of the light ray. The interocular luminance analyzing unit 30 analyzes a luminance perceived between the eyes of an observer, based on the luminance distribution image, and generates a stereoscopy determination image. The stereoscopy determining unit 40 determines a certain region in the radiation angle direction in front of the 3D display, as a stereoscopy possible region, based on the stereoscopy determination image.

Figure 2:
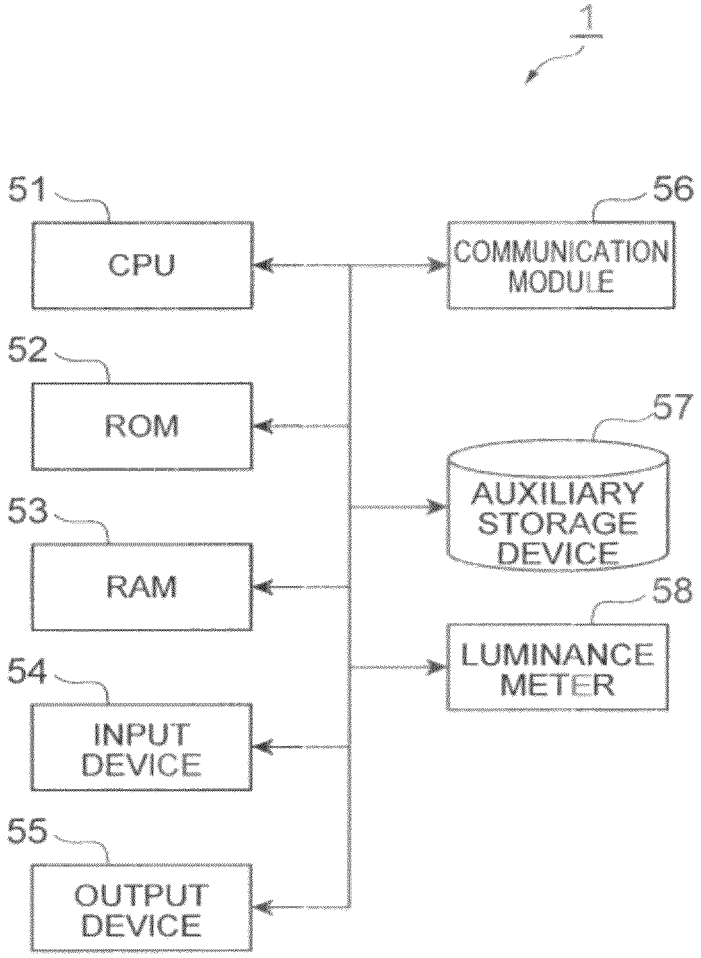
FIG. 2 is a hardware configuration diagram of the optical property evaluation apparatus 1.

FIG. 2 is a hardware configuration diagram of the optical property evaluation apparatus 1. As shown in FIG. 2, the optical property evaluation apparatus 1 is physically configured as a general computer system to mainly include a CPU 51, a main storage device such as a ROM 52 and a RAM 53, an input device 54 such as a keyboard and a mouse, an output device 55 such as a 3D display, a communication module 56 for transmission/reception of data to/from another device, and an auxiliary storage device 57 such as a hard disk. The optical property evaluation apparatus 1 further includes a luminance meter 58. The luminance meter 58 corresponds to the luminance measuring unit 10 in FIG. 1. Each function of the optical property evaluation apparatus 1 is implemented by causing predetermined computer software to be read on hardware such as the CPU 51, the ROM 52, and the RAM 53 to operate the input device 54, the output device 55, the communication module 56, and the luminance meter 58 under the control of the CPU 51, and by reading data from and writing data to the main storage device 52, 53 and the auxiliary storage device 57.

(Operation of Optical Property Evaluation Apparatus 1)

Figure 3:
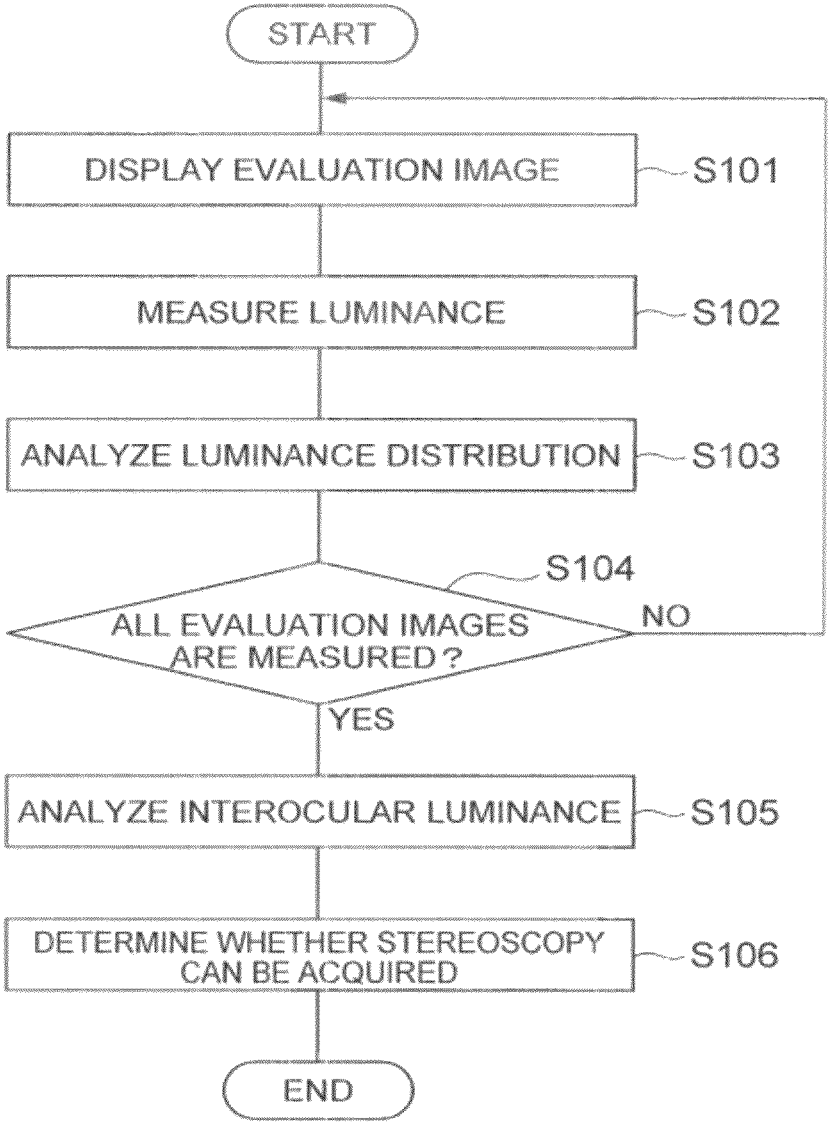
FIG. 3 is a flowchart for explaining an operation of the optical property evaluation apparatus 1.

An operation of the optical property evaluation apparatus 1 (corresponding to the "method for evaluating optical properties of a three-dimensional display" in the claims) will be described in detail below with reference to the flowchart in FIG. 3. In the following description, the two-view type and multi-view type 3D displays will be described first, and the integral type 3D display will be described separately in the section of "Integral Type". This is because the two-view type and multi-view type 3D displays have the concept of viewpoint whereas the integral type 3D display does not have the concept of viewpoint.

(Two-View Type and Multi-View Type)

The operation of the optical property evaluation apparatus 1 in the case of two-view type and multi-view type 3D displays will be described in detail below with reference to the flowchart in FIG. 3.

First, the preconditions for performing the process shown in FIG. 3 will be described. In the first embodiment, a two-view type or multi-view type 3D display is used, which can present images of N viewpoints. That is, the maximum number of viewpoints in a two-view type or multi-view type 3D display in the first embodiment is N. An evaluation image is first prepared. Specifically, evaluation images are prepared by the number of viewpoints such that only an image of one viewpoint is full-screen white (entirely white) and images of all the other viewpoints are full-screen black (entirely black). As the maximum number of viewpoints in the first embodiment is N, N evaluation images 1 to N are prepared. More specifically, evaluation image 1: entirely white only for viewpoint 1 and entirely black images for viewpoints 2 to N evaluation image 2: entirely white only for viewpoint 2 and entirely black images for viewpoint 1 and viewpoints 3 to N

. . .

evaluation image k: entirely white only for viewpoint k and entirely black images for viewpoints 1 to (k−1) and (k+1) to N

. . .

evaluation image N: entirely white only for viewpoint N and entirely black images for viewpoints 1 to (N−1).

Next, evaluation images k (k=1 to N) are successively displayed on the 3D display (step S101). Then, in a state in which an evaluation image k is displayed, the luminance measuring unit 10 measures the luminance in the radiation angle direction of the light ray radiated from a predetermined measurement point on the 3D display (step S102, which corresponds to the "luminance measuring step" in the claims).

Figure 4:
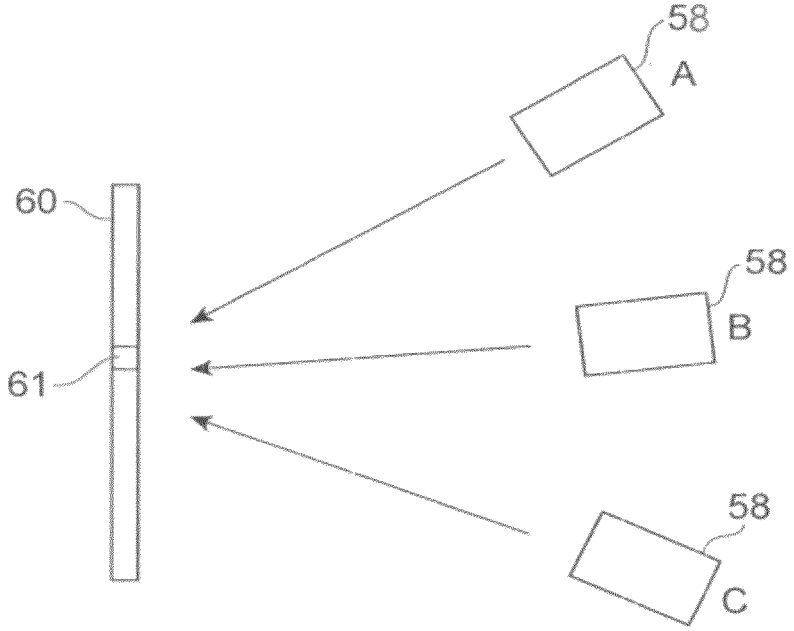
FIG. 4 is a diagram showing a manner in which a luminance meter 58 measures a luminance in a radiation angle direction of a light ray radiated from a predetermined measurement point 61 on a 3D display 60 in step S102.

For example, as shown in FIG. 4, to obtain the luminance distribution of the light ray radiated from a predetermined measurement point 61 on a 3D display 60, the luminance meter 58 movable on the circumference of a circle at certain distances is moved, for example, from position A to position B, from position B to position C, in front of the 3D display 60 so as to measure the luminance at each position. In actuality, the luminance meter 58 is moved at certain intervals (for example, at intervals of one degree) to measure the luminance of the measurement point 61 at each position.

Next, the measurement results at all the positions are synthesized for one evaluation image k to generate a luminance distribution image of the light ray radiated from the measurement point 61 (step S103, which corresponds to the "luminance distribution analyzing step" in the claims).

Figure 5:
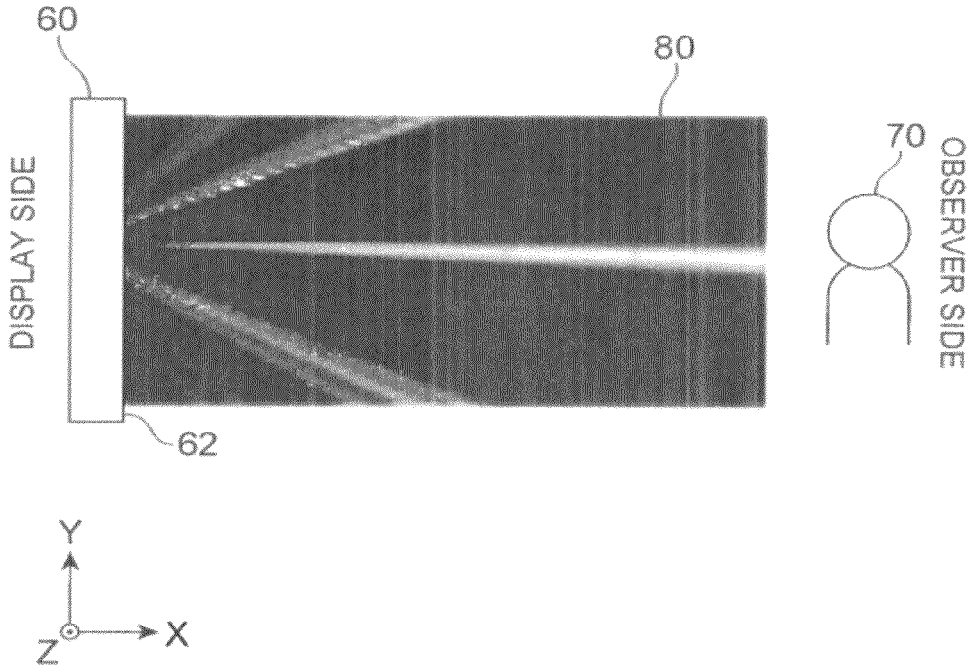
FIG. 5 is a diagram showing an example of a luminance distribution image generated in step S103.

FIG. 5 is a diagram showing an example of a luminance distribution image of the evaluation image k generated in step S103. In a luminance distribution image 80 shown in FIG. 5, a white portion indicates a high luminance portion and a black portion indicates a low luminance portion. Therefore, only when the light ray at the high luminance portion enters the eyes of an observer 70, the observer 70 can perceive a bright spot on the 3D display 60. In other words, even if the eyes of the observer 70 are placed on a position other than the high luminance portion, the observer 70 cannot perceive light on the 3D display 60. The luminance distribution image 80 is an image showing the luminance distribution in a region in front of the 3D display 60, which is in FIG. 5 a region between the 3D display 60 and the observer 70, on a plane orthogonal to a display surface 62 of the 3D display 60, in particular, on a two-dimensional plane across a central horizontal plane of the 3D display 60. In FIG. 5, the display surface 62 of the 3D display 60 is on the YZ plane, and the luminance distribution image 80 shows a luminance distribution on the XY plane.

Next, in all the viewpoints of the 3D display, a luminance distribution state for each viewpoint is analyzed. That is, the process in step S101 to step S103 described above is repeated by the number of viewpoints N to generate (N) luminance distribution images for each viewpoint (step S104).

Next, the interocular luminance analyzing unit 30 extracts two luminance distribution images corresponding to the interocular distance of the observer (the distance between the left and right eyes, about 6.5 cm), from among the luminance distribution images for each viewpoint that are generated by the luminance distribution analyzing unit 20 in step S104, and analyzes a contrast ratio of luminance between the eyes of the observer using the extracted two luminance distribution images, thereby generating a stereoscopy determination image. Here, the "contrast ratio of luminance" refers to a ratio between light that should enter and light that should not enter the observer's right and left eyes (step S105, which corresponds to the "interocular luminance analyzing step" in the claims).

Figure 6:
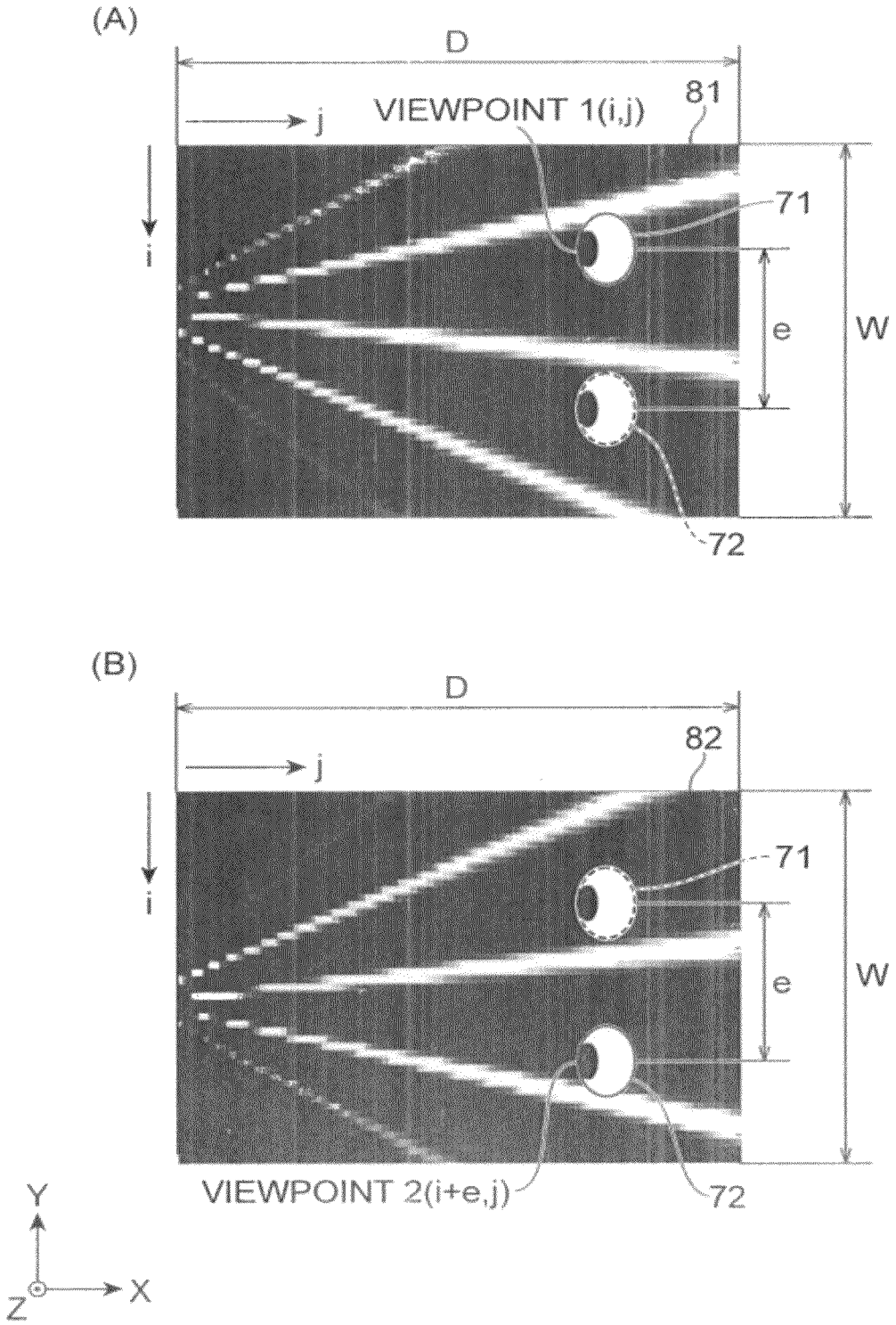
FIG. 6 is a diagram showing two luminance distribution images extracted in step S105.

Step S105 will be described in more detail below. For example, in a case where the observer acquires a stereoscopy with viewpoint 1 and viewpoint 2, the stereoscopy can be acquired by the observer when the image of viewpoint 1 is observed by the right eye of the observer and the image of viewpoint 2 is observed by the left eye of the observer. It is noted that "stereoscopy" which is also referred to as "binocular vision" refers to that an observer perceives a stereoscopic view through a 3D display. FIG. 6 shows two luminance distribution images 81 and 82 extracted in step S105. FIG. 6(A) shows the luminance distribution image 81 corresponding to the image of viewpoint 1 observed by the right eye of the observer, and FIG. 6(B) shows the luminance distribution image 82 corresponding to the image of viewpoint 2 observed by the left eye of the observer.

Here, it is assumed that the interocular distance of the observer corresponds to e pixels on the luminance distribution image. That is, when the right eye of the observer is placed on any given pixel (i, j) of the luminance distribution image 81 of viewpoint 1, the left eye of the observer is physically arranged on (i+e, j). Therefore, the value of the pixel (i+e, j) of the luminance distribution image 82 of viewpoint 2 corresponds to the light ray luminance when the image of viewpoint 2 is observed by the left eye. That is, assuming that the luminance of the viewpoint 1 observed by the right eye has the value at (i, j) of the luminance distribution image 81 and the luminance of the image of viewpoint 2 observed by the left eye has the value at (i+e, j) of the luminance distribution image 82, the product of the two values can be defined as the "interocular luminance."

In actuality, in order to consider leaked light, the ratio between light that should enter both eyes and light that should not enter, that is, the contrast of luminance, is defined, and the product thereof is used. For example, light of the image of viewpoint 2 is present as leaked light in the right eye that sees the image of viewpoint 1. That is, when the right eye is located at (i, j), the pixel value at (i, j) of the luminance distribution image 82 of viewpoint 2 is leaked light to the right eye at viewpoint 1. Similarly, for the left eye that sees viewpoint 2, leaked light of the right eye can be obtained from the luminance distribution image 81 of viewpoint 1. That is, when luminance $I_1$ of viewpoint 1 in the right eye of the observer and luminance $I_2$ of viewpoint 2 in the left eye of the observer are targets, the luminance contrast between eyes can be defined by Equation (1) below.

[Equation 1]

$$\text{Contrast}\left(i+\frac{e}{2},\ j\right)=\sqrt{\frac{I_1(i,\ j)}{I_2(i,\ j)}*\frac{I_2(i+e,\ j)}{I_1(i+e,\ j)}} \tag{1}$$

In Equation (1), when the coordinates of the right eye in the luminance distribution image are (i, j) and the coordinates of the left eye are (i+e, j), assuming that the observer observes at the interocular central position (i+e/2, j), the value of luminance contrast between eyes can be calculated using the position (i+e/2, j) as a reference. It is noted that the definition of the luminance contrast between eyes is not limited to Equation (1) above. For example, the denominator may be the total sum of light that can arrive at the eyes (see Equation (4) below).

The interocular luminance analyzing unit 30 performs the process as described above for all the pixel positions (i, j) in the luminance distribution image, that is, finds the luminance contrasts between eyes at all the positions in the luminance distribution image and synthesizes the results altogether thereby generating a stereoscopy determination image.

Figure 7:
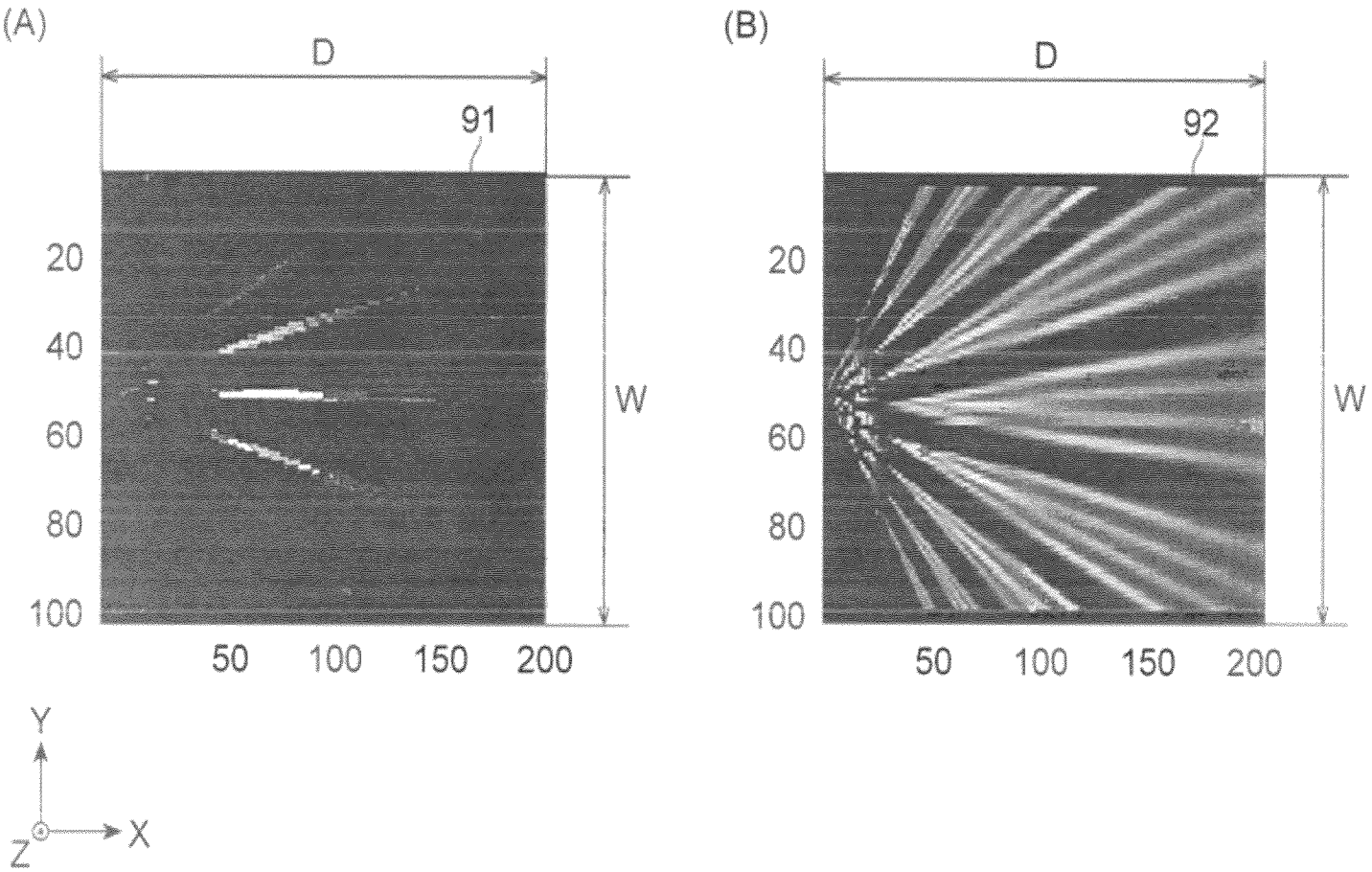
FIG. 7 is a diagram showing an example of a stereoscopy determination image generated in step S105 (in the case of the two-view type and the multi-view type).

FIG. 7 is a diagram showing an example of the stereoscopy determination image generated in step S105 described above. FIG. 7(A) shows an example of the stereoscopy determination image in the two-view type, and FIG. 7(B) shows an example of the stereoscopy determination image in the five-view type. In stereoscopy determination images 91 and 92 shown in FIG. 7, a white portion indicates a portion with a high luminance contrast, whereas a black portion indicates a portion with a low luminance contrast. Therefore, when the eyes (the right eye 71 and the left eye 72, see FIG. 6) of the observer 70 are positioned at the portion with a high luminance contrast, more specifically, when the center of the eyes 71 and 72 of the observer 70 is positioned at the portion with a high luminance contrast, the observer 70 can perceive a bright spot on the 3D display 60. In other words, even when the eyes 71 and 72 of the observer 70 are placed on a position other than the portion with a high luminance contrast, light on the 3D display 60 cannot be perceived. Similar to the luminance distribution image 80 shown in FIG. 5, the stereoscopy determination images 91 and 92 each are an image showing the luminance contrast in a region in front of the 3D display 60 and between the 3D display 60 and the observer 70, on a plane orthogonal to the display surface 62 of the 3D display 60, in particular, on the two-dimensional plane across the central horizontal plane of the 3D display 60.

In FIG. 7, although the 3D display 60 and the eyes 71 and 72 of the observer 70 shown in FIG. 5 or FIG. 6 are omitted, the display surface 62 of the 3D display 60 is on the YZ plane, and the stereoscopy determination images 91 and 92 show the distribution of luminance contrast on the XY plane, similarly to FIG. 5 or FIG. 6. Furthermore, FIG. 7 shows a state of the 3D display 60 as viewed from the top. Here, the size of each of the stereoscopy determination images 91 and 92 is represented by D pixels (the direction from the 3D display 60 toward the observer 70)×W pixels (the horizontal direction). If the lengths of D and W in the real space are measured beforehand, each pixel in the stereoscopy determination images 91 and 92 and the luminance distribution image 80 can be matched with a position in the real space where the display 60 is actually observed. Assuming that D pixels are equivalent to an observation distance 200 [cm] of the display 60, the width of one pixel in the direction D of the stereoscopy determination images 91 and 92 and the luminance distribution image 80 corresponds to 200/D [cm]. On the other hand, assuming that the size in the lateral direction, that is, W pixels, is 100 [cm] in the real space, the width of one pixel in the lateral direction is equivalent to 100/W [cm]. Since the eyes 71 and 72 of the observer can be placed on an arbitrary position, the stereoscopy determination images 91 and 92 obtained as a result of the interocular luminance analysis can also be expressed by the same coordinate system as in the luminance distribution image 80 shown in FIG. 5.

Returning to FIG. 3, the stereoscopy determining unit 40 determines a certain region in the radiation angle direction in front of the 3D display, as a stereoscopy possible region, based on the stereoscopy determination image created in step S105 described above. More specifically, the stereoscopy determining unit 40 determines, as a stereoscopy possible region, a certain region that corresponds to a portion in which the contrast ratio of luminance exceeds a predetermined threshold in the stereoscopy determination image. For example, in an example shown in FIG. 7, a portion in which the luminance contrast ratio exceeds a predetermined threshold is shown in white, and this white portion is determined as a stereoscopy possible region (step S106, which corresponds to the "stereoscopy determination step" in the claims).

The two-vision type and multi-vision type 3D displays have been described above. The foregoing description shows an example in which the number of measurement points is one (the measurement point 61 in FIG. 4). However, measurements may be performed at a plurality of measurement points (for example, M points). For example, in the case of M=3, three points at the left and right ends and the middle may be set as measurement points. In this case, the process in step S101 to step S105 described above is repeated for each measurement point, so that M kinds of stereoscopy determination images each obtained as a result of the analysis are generated. A method of obtaining a new stereoscopy determination image may be contemplated, in which the results at a plurality of measurement points are synthesized, for example, using the minimum value or mean value in each pixel in these stereoscopy determination images. Then, it can be determined whether a stereoscopy can be acquired or not based on whether the value of each pixel of the new stereoscopy determination image is equal to or greater than a predetermined threshold set beforehand.

(Integral Type)

Next, the optical property evaluation apparatus 1 in the case of the integral type 3D display will be described. In the integral type 3D display, different from the two-view type or the multi-view type, the concept of "viewpoint" does not exist. Instead, the concept of "line-of-sight direction" is used.

The optical property evaluation apparatus 1 in the case of the integral type 3D display is basically the same as compared with the two-vision type or the multi-vision type except for the difference of the concept of "view" and the concept of "line-of-sight direction." That is, except for the description separately given below, the same as described in the section of "Two-Vision Type and Multi-Vision Type" above is applicable to the integral type 3D display. More specifically, in the optical property evaluation apparatus 1 in the case of the integral type 3D display, the luminance measuring unit 10 measures a luminance in a radiation angle direction of a light ray radiated from a predetermined measurement point on the 3D display. The luminance distribution analyzing unit 20 analyzes a luminance distribution state in the radiation angle direction of the light ray, based on luminance data measured by the luminance measuring unit 10, and generates a luminance distribution image of the light ray. Specifically, the luminance distribution analyzing unit 20 analyzes the luminance distribution state for each line-of-sight direction and generates a luminance distribution image for each line-of-sight direction, in all the line-of-sight directions of the 3D display. The interocular luminance analyzing unit 30 analyzes the luminance perceived between the eyes of the observer and generates a stereoscopy determination image. Specifically, the interocular luminance analyzing unit 30 extracts two luminance distribution images corresponding to the interocular distance of the observer from among the luminance distribution images for each line-of-sight direction that are generated by the luminance distribution analyzing unit 20, and analyzes the contrast ratio of luminance between the eyes of the observer using the extracted two luminance distribution images, thereby generating a stereoscopy determination image. The stereoscopy determining unit 40 determines a certain region in the radiation angle direction in front of the 3D display, as a stereoscopy possible region, based on the stereoscopy determination image.

A description specifically related to the integral type 3D display will be given below. The integral type 3D display is characterized in that images of a plurality of line-of-sight directions can be displayed simultaneously at high density. That is, the integral type 3D display allows observing images at any distance, independently of the observation distance to the 3D display, as long as the images of the line-of-sight directions are in the same direction. As any combination of line-of-sight directions can be made, for example, in a case of the integral type 3D display having light rays in N line-of-sight directions, there are ${}_{N}C_{2}$ combinations of line-of-sight directions that produce binocular parallax, that is, combinations of line-of-sight directions that can establish a stereoscopy.

To obtain a luminance contrast, first, the product of luminance contrasts is obtained similarly to the case of the two-vision type, for each of individual combinations of line-of-sight directions (${}_N C_2$ ways). A stereoscopy possible region varies depending on the combination of line-of-sight directions. In the integral type 3D display, the sum of combination regions serves as a stereoscopy possible region of the 3D display. Assuming that an image of the line-of-sight direction having the maximum luminance can be seen, and given that the other light is leaked light, the adaptation to the integral type is considered as follows. That is, when an image of a line-of-sight direction kk is observed by the right eye and the image of a line-of-sight direction nn is observed by the left eye, light other than the image of the line-of-sight direction kk is leaked light for the right eye. On the other hand, all the light other than the image of the line-of-sight direction nn is leaked light for the left eye. When this is represented by a mathematical expression, Equation (2) below can be defined as a luminance contrast.

[Equation 2]

$$\text{Contrast}(i, j)_{integral} = \sum_{kk=1}^{N} \text{Max}_{nn=kk+1}^{N} \left( \sqrt{\frac{I_{kk}(i, j)}{\sum_{l \neq kk} I_l(i, j)} * \frac{I_{nn}(i+e, j)}{\sum_{l \neq nn} I_l(i+e, j)}} \right) \quad (2)$$

Figure 8:
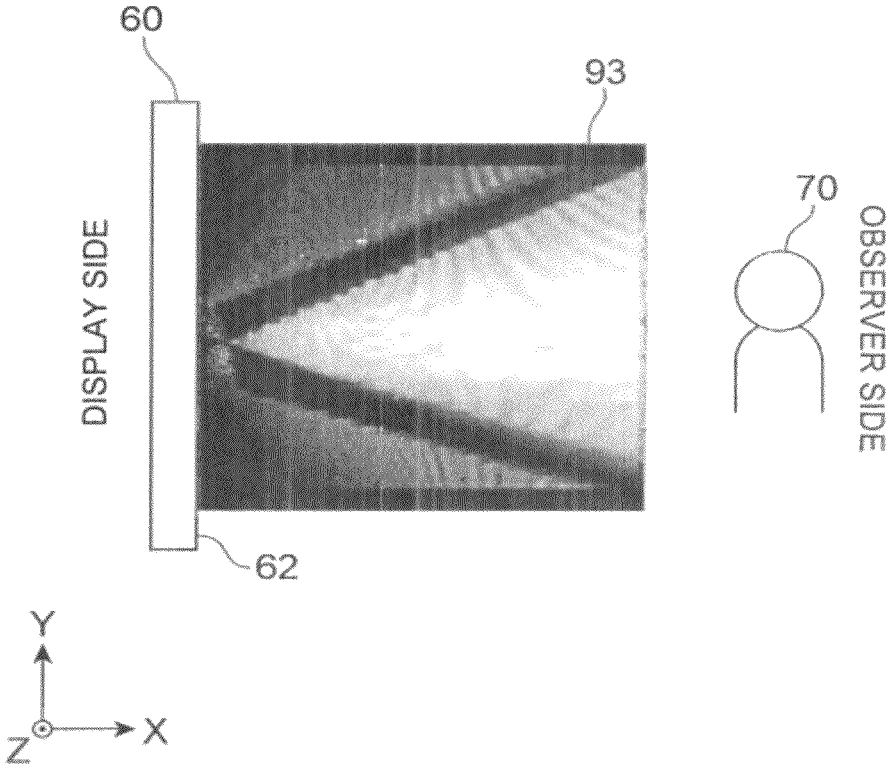
FIG. 8 is a diagram showing an example of a stereoscopy determination image generated in step S105 (in the case of the integral type).

The result of obtaining the stereoscopy determination image 91 using Equation (2) is shown in FIG. 8, in which light and shade are shown in 256 levels grey scale. A high luminance portion (white portion) is a region in which the value of the luminance contrast obtained by Equation (2) above is high, and the white portion can be determined as a region in which a stereoscopy (binocular vision) can be acquired. A region having a predetermined threshold luminance or higher (for example, 125 level or higher) is determined as a stereoscopy possible region (binocular vision possible region) from the stereoscopy determination image 93 shown in FIG. 8.

The integral type 3D display has been described above. The foregoing description shows an example in which the number of measurement points is one. However, measurements may be performed at a plurality of measurement points (for example, M points). This makes it possible to obtain a more accurate visible region. In the case where a plurality of points are measured, for example, the minimum value in each pixel may be selected similarly to the foregoing example of the two-vision type. In this case, the value of the luminance contrast can be found by Equation (3) below.

[Equation 3]

$$\text{Contrast}(i, j)_{integral\ Multi} = \text{Min}_{m=1}^{M} \left[ \sum_{kk=1}^{N} \text{Max}_{nn=kk+1}^{N} \left( \sqrt{\frac{I_{kk}(i, j)}{\sum_{l \neq kk} I_l(i, j)} * \frac{I_{nn}(i+e, j)}{\sum_{l \neq nn} I_l(i+e, j)}} \right) \right] \quad (3)$$

(Pseudoscopic Vision)

Next, a "pseudoscopic vision" will be described. For example, when the integral type 3D display has light rays in N line-of-sight directions, there are ${}_N C_2$ combinations of line-of-sight directions that produce binocular parallax, that is, combinations of line-of-sight directions that can establish a stereoscopy. Here, if the image for the right eye is projected onto the left eye and the image for the left eye is projected onto the right eye, a state called "pseudoscopic vision" occurs, in which a precise stereoscopy cannot be acquired. Then, in the first embodiment, attention is given to a manner of numbering the line-of-sight directions in order to take this "pseudoscopic vision" into consideration in determining whether a stereoscopy can be acquired.

Figure 9:
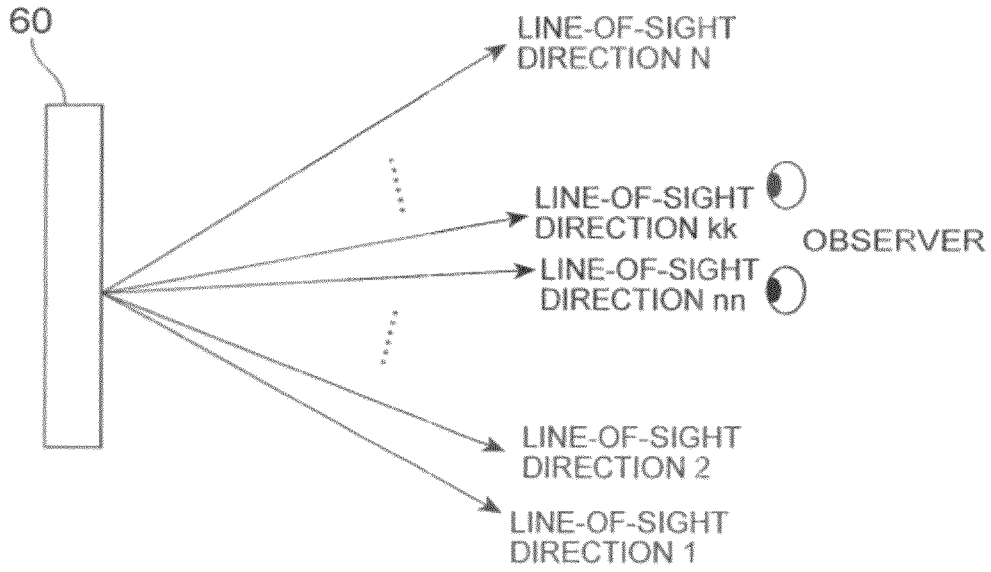
FIG. 9 is a diagram showing a manner of numbering line-of-sight directions in a case where a pseudoscopic vision is considered.

FIG. 9 is a diagram showing a manner of numbering the line-of-sight directions in the first embodiment. In the first embodiment, as shown in FIG. 9, numbers are given in order from the left of an observer facing the display 60. Accordingly, when the image of the line-of-sight direction nn enters the left eye of the observer and the image of the line-of-sight direction kk enters the right eye, if the numeric values nn and kk satisfy nn≤kk, they can be a combination that provides a normal stereoscopy. With the combination of images of the line-of-sight directions that establishes binocular parallax, a stereoscopy can be acquired. On the other hand, if nn>kk, it is determined that the combination of images of the line-of-sight directions may be observed as a "pseudoscopic vision" or double image. If nn=kk, it is a state in which the same image is seen in the left and right eyes, in which not a stereoscopic but merely two-dimensional image is observed.

(First Way to Obtain Luminance Distribution Image and Stereoscopy Determination Image in Consideration of "Pseudoscopic Vision")

A first way to obtain a luminance distribution image and a stereoscopy determination image when a "pseudoscopic vision" is considered will be described below. In the case of the integral type 3D display having images of N line-of-sight directions, there are ${}_N C_2$ combinations of line-of-sight directions. For all those combinations, a luminance distribution image and a stereoscopy determination image are obtained through the following steps S201 to S204.

(Step S201)

A light ray incident at the maximum luminance is detected in an individual pixel in a region (a region equivalent to D×W as shown in FIG. 6 and FIG. 7) occupied by the luminance distribution image and the stereoscopy determination image.

(Step S202)

The total sum of luminances of all the light rays incident on the pixel is calculated to find the ratio (hereinafter referred to as the "luminance value") with the maximum luminance detected in the step S201 above.

(Step S203)

The luminance value in step S202 above is calculated for all the pixels, and a luminance distribution image is generated based on the calculated luminance values. Here, the calculated value of luminance value and the number of the line-of-sight direction in which the maximum luminance enters are held in each pixel.

(Step S204)

The right eye of the observer is arranged successively at a position (i, j) of each pixel. If the interocular distance of the observer corresponds to e pixels, the left eye is arranged at (i+e, j). The luminance values corresponding to the positions of the eyes of the observer are extracted from the luminance distribution image obtained in the step S203 above and are subjected to the calculation process for stereoscopy determination (such a process of calculating the value of luminance contrast between eyes based on Equation (1) in step S105 above). The result is substituted into the position (i+e/2, j) in the stereoscopy determination image. Here, nn (left eye) and kk (right eye) which are the numbers of line-of-sight directions registered in the pixels corresponding to the left and right eyes are extracted. Then, if nn≤kk, the process result above is kept at a positive value, and if nn>kk, the value of the process result above is given a negative sign. That is, the value of the process result above (the value of the luminance contrast ratio between eyes that is registered at the position (i+e/2, j) in the stereoscopy determination image) does not entail a sign change when light that should enter the observer's right eye enters the right eye and light that should enter the observer's left eye enters the left eye, whereas the value entails a sign change when light that should enter the observer's right eye enters the observer's left eye or when light that should enter the observer's left eye enters the observer's right eye. In this manner, the value of the luminance contrast ratio between eyes in consideration of a pseudoscopic vision can be calculated.

Similar processing is performed for all the positions in the stereoscopy determination image, thereby completing the stereoscopy determination image. When a geometric mean of the luminance values of the left and right eyes is used as an example of the stereoscopy determination operation process, the value of the luminance contrast between eyes that is substituted into the position (i+e/2, j) can be expressed by Equation (4) below.

[Equation 4]

$$\text{Contrast}\left(i+\frac{e}{2},\ j\right)=\sqrt{\left(\frac{I_{kk}^{right}(i,\ j)}{\sum_{l=1}^{N} I_l(i,\ j)}\right)*\left(\frac{I_{nn}^{left}(i+e,\ j)}{\sum_{l=1}^{N} I_l(i+e,\ j)}\right)} \tag{4}$$

In Equation (4), $I_{kk}^{right}(i, j)$ represents a luminance value in the case where the image of the line-of-sight direction kk enters the right eye at a position corresponding to (i, j), $I_{nn}^{left}(i+e, j)$ represents a luminance value in the case where the image of the line-of-sight direction nn enters the left eye at a position corresponding to (i+e, j), and N represents the total number of line-of-sight directions.

The "case of the integral type 3D display having N line-of-sight directions" has been described above by way of example. The same applies to the "case of the two-view type and multi-view type 3D displays." In this case, "images of N line-of-sight directions" are replaced by "images of N viewpoints" in the description of steps S201 to S204 above.

Figure 10:
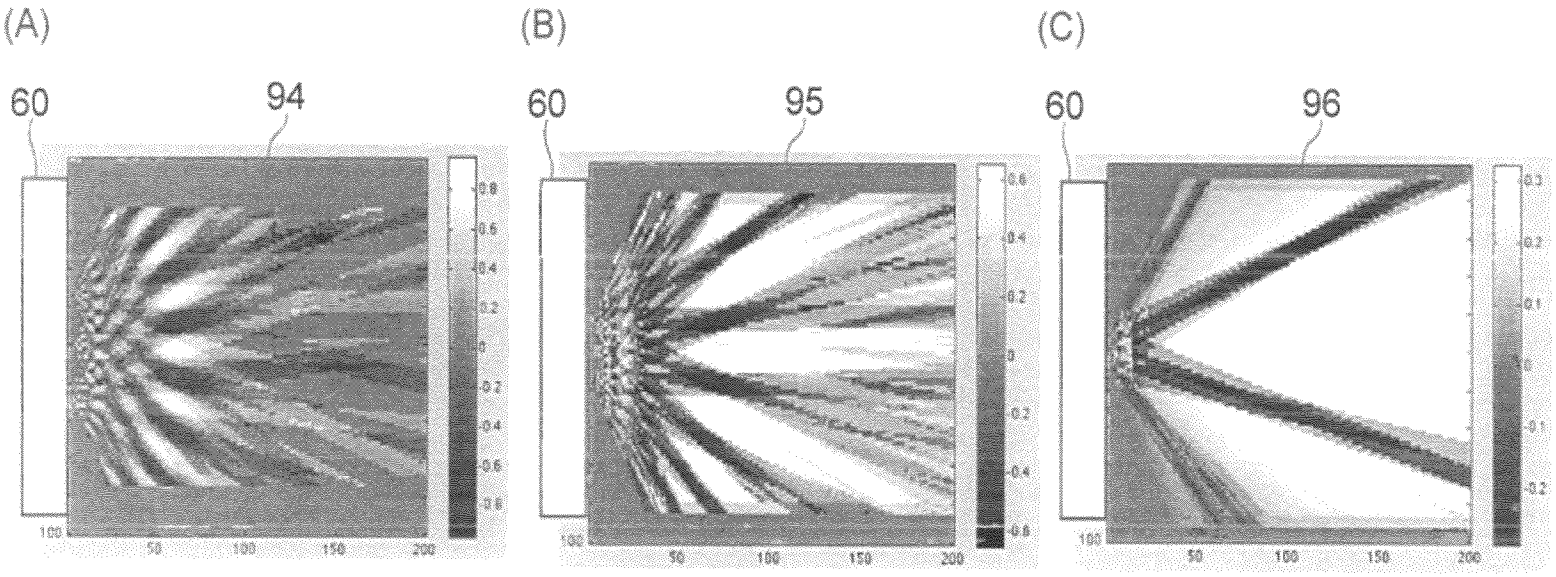
FIG. 10 is a diagram showing an example of a stereoscopy determination image obtained in a case where a pseudoscopic vision is considered.

FIG. 10 shows an example of the stereoscopy determination image obtained through the steps S201 to S204 above. FIG. 10(A) shows a stereoscopy determination image 94 in the case of the two-view type, FIG. 10(B) shows a stereoscopy determination image 95 in the case of the five-view type as an example of the multi-view type, and FIG. 10(C) shows a stereoscopy determination image 96 in the case of the integral type having images of 30 line-of-sight directions. A portion with a high luminance (white portion) represents a region in which a stereoscopy is established, and a black portion represents a region in which a "pseudoscopic vision" is produced. As shown in the stereoscopy determination image 94 in FIG. 10(A), in the case of the two-view display, the stereoscopic regions (white regions) and the pseudoscopic regions (black regions) alternately appear at a fine pitch. As shown in the stereoscopy determination image 95 in FIG. 10(B), in the case of the five-view display, it can be recognized that the stereoscopic regions (white regions) are kept wider as compared with the two-view type, and a small pseudoscopic region appears between the stereoscopic regions. As shown in the stereoscopy determination image 96 in FIG. 10(C), in the case of the integral type display, it is understood the further wider stereoscopic regions (white portions) as compared with the two-view or multi-view type are produced.

Figure 11:
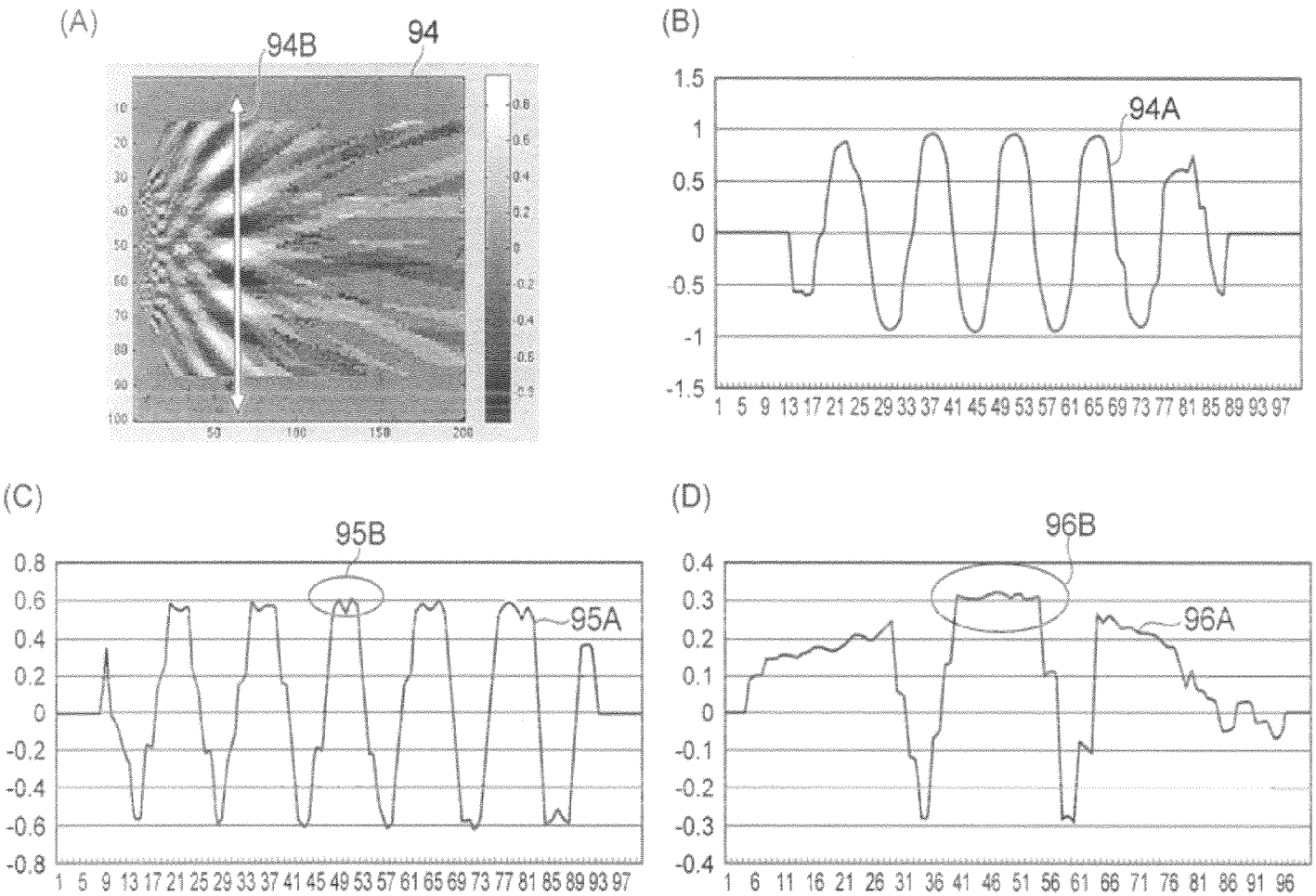
FIG. 11 is a diagram showing a result of extracting a luminance contrast at a position at a certain distance away from the display 60 in a case where a pseudoscopic vision is considered.

FIG. 11 shows the result of extracting a luminance contrast at a position at a certain distance away from the display 60. FIG. 11(A) shows that the variation of luminance contrast is extracted at a certain observation position (a cross-sectional position indicated by the line 94B, which corresponds to the position 60 cm away from the display 60 in this example) from the stereoscopy determination image 94 in the case of the two-view type shown in FIG. 10(A). The result of the extraction is shown as a graph 94A in FIG. 11(B). Similarly, a graph 95A in FIG. 11(C) shows the variation of luminance contrast of the stereoscopy determination image 95 in the case of the five-view type shown in FIG. 10(B) at the same observation position, and a graph 96A in FIG. 11(D) shows the variation of luminance contrast of the stereoscopy determination image 96 in the case of the integral type shown in FIG. 10(C) at the same observation position. In FIG. 11(B) to FIG. 11(D), the abscissa shows the observation position (the center of the abscissa corresponds to the front central position of the display 60), and the ordinate shows the luminance contrast value.

In the graph 94A shown in FIG. 11(B), the regions with a high luminance contrast value and the regions with a low luminance contrast value alternately appear. That is, it can be understood from this graph that the regions in which a clear stereoscopic image can be observed and the pseudoscopic regions alternately appear. In the graph 95A shown in FIG. 11(C), the portion (the portion indicated by 95B) in which the value of the luminance contrast is high is flat as compared with the graph 94A, and it can be understood that the regions in which a stereoscopy can be acquired appear more frequently than the pseudoscopic regions. In the graph 96A shown in FIG. 11(D), the portion (the portion indicated by 96B) in which the value of the luminance contrast is high is further flatter as compared with the graph 95A, and it can be understood that the regions in which a stereoscopy can be acquired appear even more frequently than the pseudoscopic regions. That is, in the case of the integral type, changing the observation positions does not cause a pseudoscopic vision, and the 3D display in different line-of-sight directions changes smoothly. In other words, it is understood that motion parallax is realized. In this manner, according to the first embodiment, the characteristics of how a 3D display is viewed can be evaluated based on the variation width in the graph of variation of luminance contrast, and the frequency of variation.

(Second Way to Obtain Luminance Distribution Image and Stereoscopy Determination Image in Consideration of "Pseudoscopic Vision")

A second way to obtain a luminance distribution image and a stereoscopy determination image when a "pseudoscopic vision" is considered will be described below. In the following procedure, step S301, step S305 and step S306 are substantially the same procedure as the foregoing step S201, step S203 and step S204. It can be said that the difference between the following procedure in steps S301 to S306 and the foregoing procedure in steps S201 to S204 is the difference as to "how desired light and undesired light should be interpreted in creating a stereoscopy determination image." More specifically, in the foregoing procedure in steps S201 to S204, it is defined that "desired light" is only a light ray having the strongest luminance among light rays distributed on the display surface, and all the other light is undesired leaked light. On the other hand, in the following procedure in steps S301 to S306, not only a light ray having the strongest luminance but also all the other light rays that satisfy specific conditions are defined as "desired light." The procedure in step S301 to S306 will be described in detail below.

(Step S301)

A light ray incident at the maximum luminance is detected in an individual pixel in a region (a region equivalent to D×W as shown in FIG. 6 and FIG. 7) occupied by the luminance distribution image and the stereoscopy determination image.

(Step S302)

Figure 12:
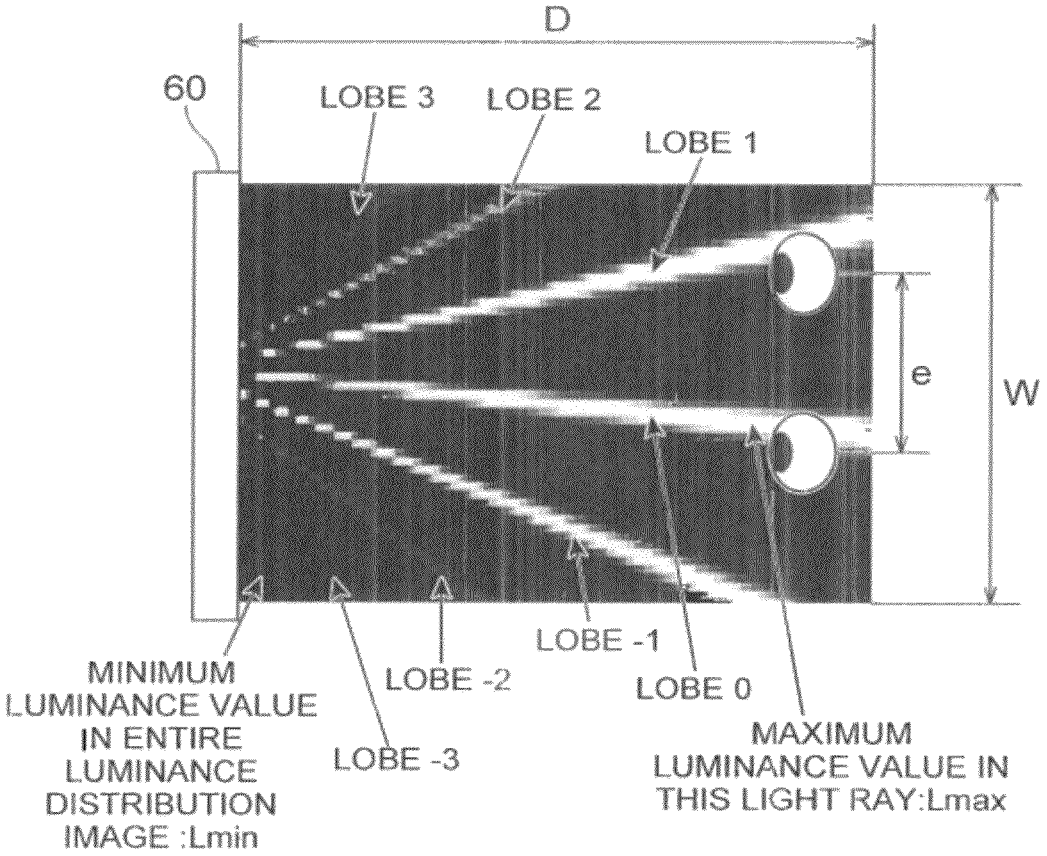
FIG. 12 is a diagram for explaining a lobe region in the first embodiment.

A lobe region in each pixel is defined for each of 1 to N line-of-sight directions. Here, the "lobe region" refers to a region (white portion) occupied by each light ray in a luminance distribution image (for example, see FIG. 5). FIG. 12 is a diagram for explaining the "lobe region" in step S302 more specifically. In FIG. 12, seven lobe regions are defined. The lobe region closest to the front of the display 60 is numbered "lobe 0," and the lobe regions are numbered to have a higher value toward the right of an observer facing the display 60, whereas the lobe regions are numbered to have a lower value toward the left of an observer facing the display 60.

The pixel belonging to each lobe region is a pixel that satisfies the boundary condition in Equation (5) below. More specifically, a pixel having a luminance value L (i, j) that satisfies the boundary condition in Equation (5) below can be said to be the pixel belonging to the lobe region, where the threshold Th set beforehand, the maximum luminance value Lmax in the lobe, and the minimum luminance value Lmin in the entire luminance distribution image are used as parameters. In FIG. 12, the maximum luminance value Lmax in lobe 0 and the minimum luminance value Lmin in the entire luminance distribution image are illustrated. The more detailed description for the "lobe region" will be given in the second embodiment below.

[Equation 5]

$$\frac{L(i, j)}{L_{max} - L_{min}} < Th \tag{5}$$

(Step S303)

The total of luminance values belonging to the lobe given the same number as the light ray having the maximum luminance detected in step S301 above is found for each pixel.

(Step S304)

For each pixel, the total sum of luminances of all the light rays incident on the pixel is calculated to find the ratio (hereinafter referred to as a "luminance value") with the total luminance value of the same lobe that is calculated in step S303 above.

(Step S305)

For all the pixels, the luminance value in step S304 above is calculated, and a luminance distribution image (the one equivalent to the "luminance distribution image" in the foregoing step S203) is generated based on the calculated luminance value. Here, the calculated value of luminance value and the number of line-of-sight direction in which the maximum luminance enters are held in each pixel.

(Step S306)

The observer's right eye is arranged successively at a position (i, j) of each pixel. If the interocular distance of the observer corresponds to e pixels, the left eye is arranged at (i+e, j). The luminance values corresponding to the positions of the eyes of the observer are extracted from the luminance distribution images obtained in step S305 above, and the result of performing a calculation process for stereoscopy determination (such a process of calculating the value of the luminance contrast between eyes based on Equation (1) in step S105 above) is substituted into the position (i+e/2, j) of the stereoscopy determination image. Here, nn (left eye) and kk (right eye) which are numbers of the line-of-sight directions registered in the pixels corresponding to the left and right eyes are extracted. Then, if nn≤kk, the process result above is kept at a positive value, and if nn>kk, the value of the process result above is given a negative sign. That is, the value of the process result above (the value of the luminance contrast ratio between eyes that is registered at a position (i+e/2, j) in the stereoscopy determination image) does not entail a sign change when light that should enter the observer's right eye enters the right eye and light that should enter the observer's left eye enters the left eye, whereas the value entails a sign change when light that should enter the observer's right eye enters the observer's left eye or when light that should enter the observer's left eye enters the observer's right eye. In this manner, the value of the luminance contrast ratio between eyes in consideration of a pseudoscopic vision can be calculated.

Similar processing is performed for all the positions in the stereoscopy determination image, thereby completing the stereoscopy determination image. When a geometric mean of the luminance values of the left and right eyes is used as an example of the stereoscopy determination operation process, the value of the luminance contrast between eyes that is substituted into the position (i+e/2, j) can be expressed by Equation (4) given above.

(Operation and Effects of Optical Property Evaluation Apparatus 1)

Next, the operation and effects of the optical property evaluation apparatus 1 according to the first embodiment will be described. In the optical property evaluation apparatus 1 in the first embodiment, when the interocular luminance analyzing unit 30 analyzes the luminance perceived between the eyes of the observer based on the luminance distribution image, thereby generating a stereoscopy determination image, the stereoscopy determining unit 40 determines a stereoscopy possible region based on this stereoscopy determination image. This is applicable irrespective of the kind of 3D displays including the two-view type, the multi-view type, and the integral type. Therefore, with the first embodiment, the evaluation of optical properties can be performed independently of the kind of 3D displays. In addition, a stereoscopy possible region can be determined only from the optical measurement data rather than being determined after the observer actually sees the 3D display.

With the first embodiment, a luminance distribution image is generated for each viewpoint, so that the optical properties can be evaluated for all the viewpoints of the 3D display.

With the first embodiment, a luminance distribution image is generated for each line-of-sight direction, so that the optical properties can be evaluated for all the line-of-sight directions of the 3D display.

Second Embodiment

Next, another aspect of the present invention will be described as a second embodiment. The second embodiment described below has substantially the same content as described in the section of "Second Way to Obtain Luminance Distribution Image and Stereoscopy Determination Image in Consideration of 'Pseudoscopic Vision' in the first embodiment. For example, the "predetermined region corresponding to the peak of luminance distribution" in the following description means the "lobe region" in the first embodiment.

(Configuration of Viewing Angle Property Inspection Apparatus A1)

Figure 13:
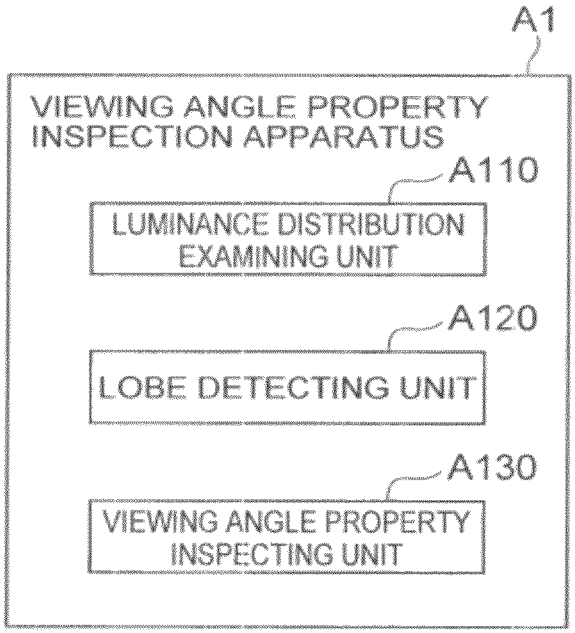
FIG. 13 is an overall configuration diagram of a viewing angle property inspection apparatus A1 according to a second embodiment.

First, a configuration of a viewing angle property inspection apparatus A1 according to a second embodiment of the present invention will be described with reference to FIG. 13. FIG. 13 is an overall configuration diagram of the viewing angle property inspection apparatus A1. As shown in FIG. 13, the viewing angle property inspection apparatus A1 is configured to include, as functional components, a luminance distribution examining unit A110, a lobe detecting unit A120, and a viewing angle property inspecting unit A130.

The luminance distribution examining unit A110 measures a luminance in a radiation angle direction of a light ray radiated from a predetermined measurement point on a three-dimensional display and examines a luminance distribution with respect to the radiation angle for each viewpoint of the three-dimensional display. The lobe detecting unit A120 detects a predetermined region corresponding to a luminance distribution peak in the luminance distribution for each viewpoint, where the luminance distribution forms a curve including a plurality of peaks and dips. The viewing angle property inspecting unit A130 determines, for any given angle of radiation, whether the given radiation angle belongs in a lobe for each viewpoint, and finds a permissible luminance contrast which is the ratio between the total of luminance values in the case where the given radiation angle belongs and the total of luminance values in the case where the given radiation angle does not belong, and inspects the viewing angle property of the three-dimensional display based on the permissible luminance contrast.

Figure 14:
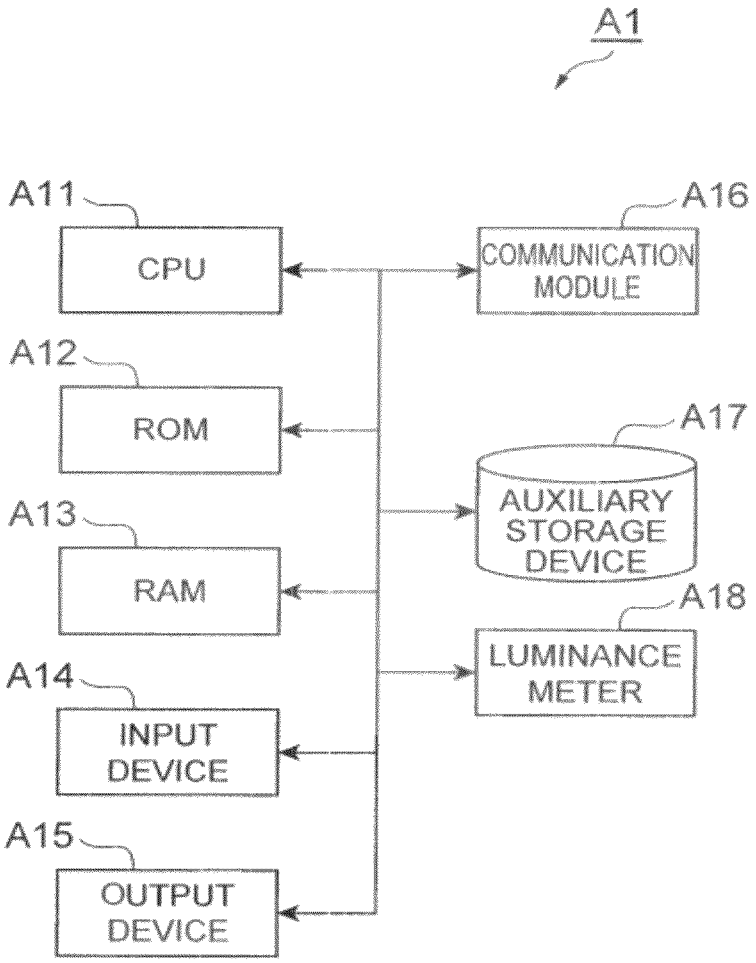
FIG. 14 is a hardware configuration diagram of the viewing angle property inspection apparatus A1.

FIG. 14 is a hardware configuration diagram of the viewing angle property inspection apparatus A1. As shown in FIG. 14, the viewing angle property inspection apparatus A1 is physically configured as a general computer system to mainly include a CPU (A11), a main storage device such as a ROM (A12) and a RAM (A13), an input device A14 such as a keyboard and a mouse, an output device A15 such as a 3D display, a communication module A16 for transmission/reception of data to/from another device, and an auxiliary storage device A17 such as a hard disk. The viewing angle property inspection apparatus A1 further includes a luminance meter A18. The luminance meter A18 corresponds to the luminance distribution examining unit A110 in FIG. 13. Each function of the viewing angle property inspection apparatus A1 is implemented by causing predetermined computer software to be read on hardware such as the CPU (A11), the ROM (A12), and the RAM (A13) to operate the input device A14, the output device A15, the communication module A16, and the luminance meter A18 under the control of the CPU (A11), and by reading data from and writing data to the main storage device A12, A13 and the auxiliary storage device A17.

(Operation of Viewing Angle Property Inspection Apparatus A1)

An operation of the viewing angle property inspection apparatus A1 will be described in detail below with reference to the flowchart in FIG. 15.

First, the preconditions for performing the process shown in FIG. 15 will be described. In the second embodiment, it is assumed that the viewing angle property is inspected for a 3D display of such a type as the integral type that is premised on that a plurality of viewpoint images are observed by the same eye. The 3D display of this kind is formed such that lenses or any other optical elements or shields such as parallax barriers are arranged on a surface of a flat panel display such as a liquid crystal display to display at least two viewpoint images at spatially different positions. In the second embodiment, it is also assumed that a 3D display capable of presenting images of N viewpoints is used. In other words, the maximum number of viewpoints in the 3D display in the second embodiment is N. First of all, an evaluation image (hereinafter also referred to as "test image") is prepared. Specifically, test images are prepared by the number of viewpoints such that only an image of one viewpoint is full-screen white (entirely white, illuminated), and images of all the other viewpoints are full-screen black (entirely black, not illuminated). As the maximum number of viewpoints in the second embodiment is N, N evaluation images 1 to N are prepared. More specifically, test image 1: the entirely white (illuminated) viewpoint image only for viewpoint 1 and the entirely black (not illuminated) viewpoint images for views 2 to N test image 2: the entirely white (illuminated) viewpoint image only for viewpoint 2 and the entirely black (not illuminated) viewpoint images for viewpoint 1 and viewpoints 3 to N

. . .

test image n: the entirely white (illuminated) viewpoint image only for viewpoint n and the entirely black (not illuminated) viewpoint images for viewpoints 1 to (n−1) and (n+1) to N

. . .

test image N: the entirely white (illuminated) viewpoint image only for viewpoint N and the entirely black (not illuminated) viewpoint images for viewpoints 1 to (N−1).

Next, test images n (n=1 to N) are successively displayed on the 3D display (step S401). Then, in a state in which a test image n is displayed, the luminance distribution examining unit A110 measures a luminance in a radiation angle direction of a light ray radiated from a predetermined measurement point on the 3D display (step S402).

Figure 16:
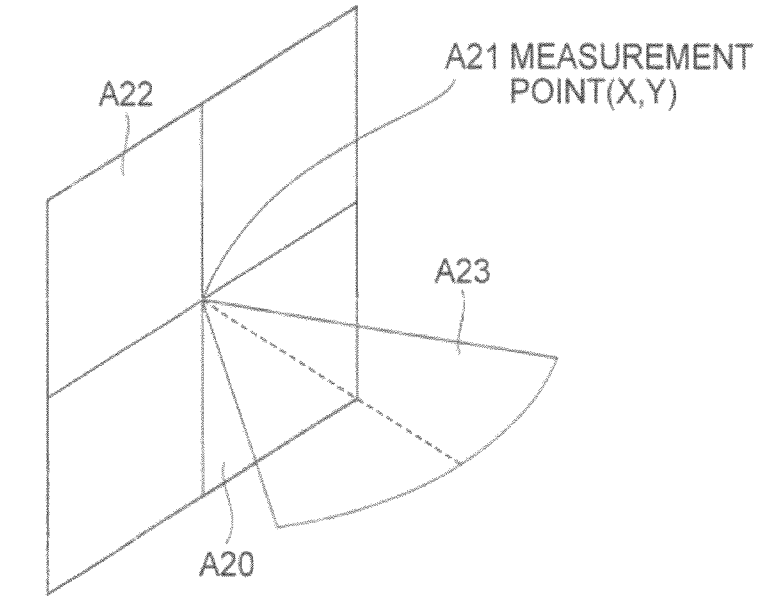
FIG. 16 is a diagram for explaining a luminance measuring process by a luminance distribution examining unit A110.
Figure 16:
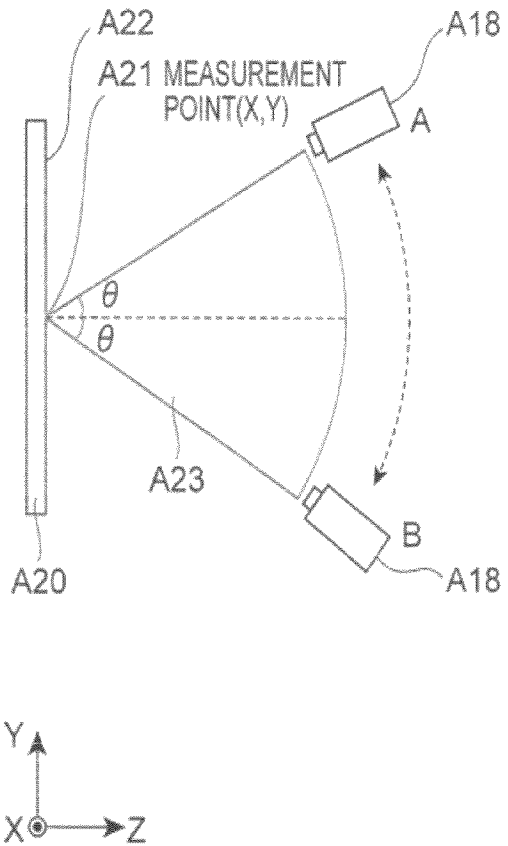

For example, as shown in FIG. 16, to obtain the luminance distribution of a light ray radiated from a predetermined measurement point A21 on a 3D display A20, the luminance meter A18 movable on the circumference of a circle at certain distances is moved from position A to position B in front of the 3D display A20 so as to measure the luminance at each position. In actuality, the luminance meter A18 is moved at certain intervals (for example, at intervals of one degree) to measure the luminance of the measurement point A21 at each position so as to obtain the luminance distribution with sufficient accuracy. In the second embodiment, the luminance distribution examining unit A110 measures the luminance in a radiation angle direction θ of a light ray radiated along a plane A23 (virtual plane) orthogonal to a display surface A22 of the 3D display A20. The plane A23 is, for example, a plane (the YZ plane in FIG. 16) horizontal to the ground, where the 3D display A20 is installed vertically (the XY plane in FIG. 16) to the ground (the YZ plane in FIG. 16). In other words, the luminance distribution examining unit A110 examines the luminance value in the horizontal direction of the light ray radiated from the measurement point A21 (X, Y) on the display surface A22 of the 3D display A20 when the n-th (1 to N) test image is displayed, for the number of viewpoints N of the 3D display A20. The "horizontal direction" is the direction on the plane A23 in FIG. 16. In FIG. 16, FIG. 16(B) is a diagram as viewed from the top of FIG. 16(A).

Figure 17:
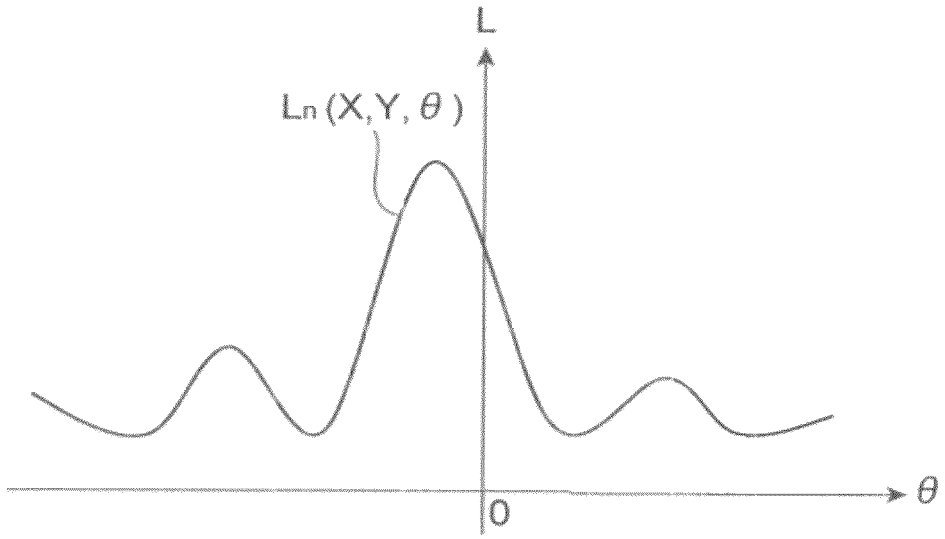
FIG. 17 is a diagram showing an example of a luminance distribution Ln (X, Y, θ) obtained by the luminance distribution examining unit A110.

Next, a luminance distribution Ln (X, Y, θ) of the light ray radiated from the measurement point A21 is found based on the luminance measurement results at all the positions for one test image n (step S403). The resulting luminance distribution Ln (X, Y, θ) is normally as shown in FIG. 17. As shown in FIG.

17, the luminance distribution Ln (X, Y, θ) forms a curve including a plurality of peaks and dips. In general, the peak located at the front portion (where θ is small) of the 3D display is the highest, and the peak is lower toward the peripheral portion (where θ is large). Other than the luminance measurement method as described above, for example, an apparatus as described in Reference Literature 1 below may be used to measure the luminance distribution Ln (X, Y, θ) at one time.

REFERENCE LITERATURE 1

"VCMaster3D: A New Fourier Optics Viewing Angle Instrument for Characterization of Autostereoscopic 3D Displays," Thierry Leroux et al., SID 09 DIGEST, pp. 115-118

Figure 18:
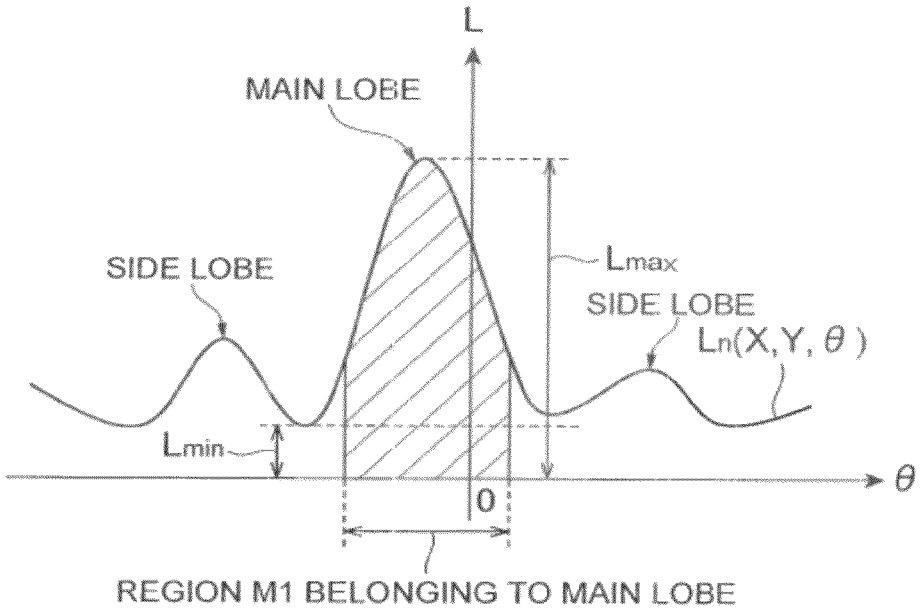
FIG. 18 is a diagram for explaining a manner in which a lobe detecting unit A120 detects a lobe and a region belonging to the lobe.

Next, the lobe detecting unit A120 detects a lobe from the luminance distribution Ln (X, Y, θ) obtained by the luminance distribution examining unit A110 (step S404). The lobe refers to the similar concept as the "Lobe" described in Reference Literature 2 below. As shown in FIG. 18, in the luminance distribution curve Ln (X, Y, θ), the peak portion closest to the front direction (θ=0) is referred to as a main lobe, and any other peak portion is referred to as a side lobe. Although not shown, when the viewpoint images are changed, the same lobe continuously appears in the direction in which the angle gradually changes. The angle between lobes varies depending on the design value of the 3D display. Because of this lobe, a repeated image is produced when the 3D display is observed, so that a region (viewing space) in which a stereoscopic image can be observed with the 3D display is determined.

REFERENCE LITERATURE 2

"MeThodology of Optical Measurement for Autostereoscopic Displays," Proc. of IDW'08, pp. 1107-1110

The lobe detecting unit A120 determines a range of θ that satisfies Equation (6) below, and detects the region corresponding to θ as a "region belonging to a lobe."

[Equation 6]

$$\frac{L(\theta)}{L_{max} - L_{min}} < Th \tag{6}$$

(where L(θ) is a luminance value at a radiation angle θ, Lmax is the maximum luminance value at a peak, Lmin is the smaller value of the minimum luminance values at two dips adjacent to the peak, and Th is a predetermined threshold.)

As shown in FIG. 18, a region corresponding to the range of θ that satisfies Equation (6) above is labeled a region M1 belonging to the main lobe, using the maximum luminance value Lmax at the highest peak located at the front portion of the 3D display, Lmin which is the smaller value of the minimum luminance values at two dips adjacent to the peak, and the predetermined threshold Th.

Here, Th represents a threshold that defines the boundary of a lobe, and is selected, for example, from numeric values such as 0.1 and 0.05. A value based on the design element or optical device configuration of the 3D display may be selected as a value of Th. For example, in a case of a 3D display in such a manner that lenticular lenses are arranged in front of a liquid crystal display to display parallax information, there is almost no shield region for light emanating from a light source, as compared with the 3D display using parallax barriers, and therefore the entire brightness is improved. Accordingly, partly because of the effects of lens aberration, each lobe detected by the lobe detecting unit A120 is relatively wide, and the peak of the luminance distribution that forms a lobe tends to be relatively gently curved. Therefore, it is preferable to select as many regions in the gentle curve as possible as lobes by selecting a smaller value than the value of Th in the property evaluation for a 3D display using barriers, so that the value of Th is set with consideration given to the effects of lens aberration and the brightness of light distributed on the whole. A value obtained in consideration of the degree of human visual recognition ability may be selected as a value of Th. For example, such a setting method is possible in that a region with a certain quantity of light or lower is determined not to belong to a lobe region, based on the sensing limit of human rod cells. Furthermore, a value of Th may be set based on both of the design element or optical device configuration of the 3D display as described above and the human recognition ability.

Figure 15:
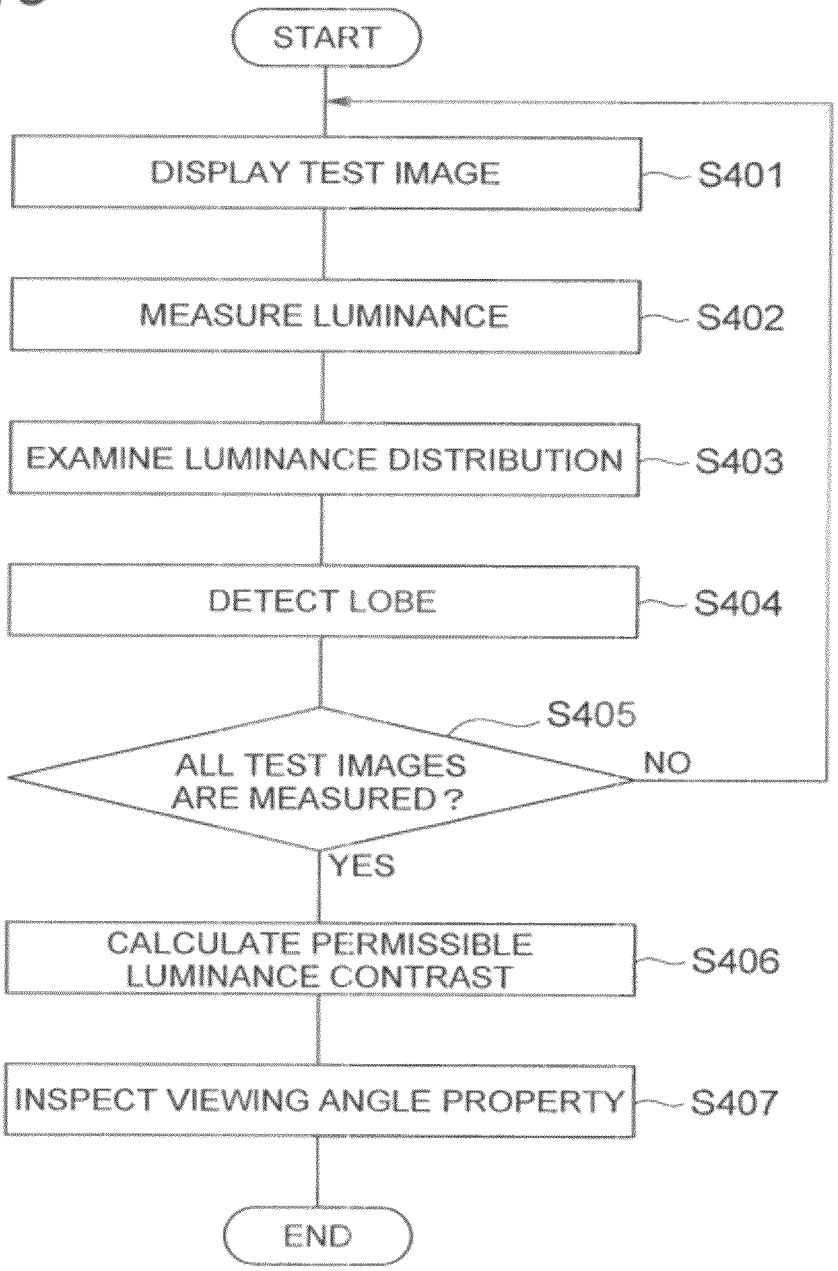
FIG. 15 is a flowchart showing an operation of the viewing angle property inspection apparatus A1.

Next, as shown in FIG. 15, in all the viewpoints of the 3D display, the luminance distribution for each viewpoint is examined, and a region belonging to a lobe is detected using Equation (6) above (step S405). That is, the process in step S401 to step S404 above is repeated by the number of viewpoints, and the luminance distribution examining unit A110 examines the luminance distribution Ln (X, Y, θ) with respect to the radiation angle θ for each viewpoint of the three-dimensional display, using N kinds of test images, for the total number of viewpoints N of the three-dimensional display. Then, the lobe detecting unit A120 detects a region belonging to a lobe, for the luminance distribution Ln (X, Y, θ) for each viewpoint.

Next, the viewing angle property inspecting unit A130 determines, for any given radiation angle θ, whether the given radiation angle θ belongs in a lobe for each viewpoint, finds a permissible luminance contrast which is the ratio between the total of luminance values in the case where the given radiation angle belongs and the total of luminance values in the case where the given radiation angle does not belong (step S406), and inspects the viewing angle property of the three-dimensional display based on the permissible luminance contrast (step S407). The permissible luminance contrast at the measurement point (X, Y) on the display surface of the 3D display can be calculated using Equation (7) below.

[Equation 7]

$$C_l(X, Y, \theta) = \frac{\sum_{i \in l} (L_i(X, Y, \theta))}{\sum_{j \notin l} (L_j(X, Y, \theta))} \tag{7}$$

Here, Li and Lj are a luminance distribution measured by the luminance distribution examining unit A110, and $i \in l$ indicates that when a test image i is illuminated, the angle θ at the point (X, Y) on the display surface is included in a lobe 1. On the other hand, $j \notin l$ [Equation 8]

shows that when a test image j is illuminated, the angle θ at the point (X, Y) on the display surface is not included in a lobe 1.

The determination for any given radiation angle θ as to whether the given radiation angle θ belongs in any given lobe is made by the viewing angle property inspecting unit A130 which determines whether the given radiation angle θ is included in the "region belonging to a lobe" detected by the lobe detecting unit A120 in the process in step S404 described above. Alternatively, it can be made by the viewing angle property inspecting unit A130 which directly uses Equation (6) above to confirm whether the given radiation angle θ to be determined satisfies Equation (6).

A permissible luminance contrast C1 (X, Y, θ) obtained through the method as described above represents the ratio between the total of luminance values belonging to the same lobe and the total of other luminance values, of the luminances at any given radiation angle θ at a position (X, Y) on the display surface when each of test images 1 to N is illuminated. If the value of the permissible luminance contrast C1 thus calculated is high, it can be said that the luminance information obtained when the display position (X, Y) is observed from the direction of the angle θ is mostly formed of viewpoint images that do not have adverse effects in terms of the design concept of the integral type. On the other hand, if the value of the permissible luminance contrast C1 is low, it means that much crosstalk having adverse effects is included, which consequently causes blurring of an image or an image causing a pseudoscopic vision to be observed when a stereoscopic image is displayed.

Operation and Effects of Second Embodiment

Next, the operation and effects of the viewing angle property inspection apparatus A1 according to the second embodiment will be described. In the viewing angle property inspection apparatus A1 in the second embodiment, in a three-dimensional display of such a type as the integral type that is premised on that a plurality of viewpoint images are observed by the same eye, of the overlaps between the adjacent viewpoint images, an overlap that has adverse effects on a stereoscopic image to be observed and an overlap that does not necessarily have adverse effects are distinguished from each other, whereby the optical properties of the three-dimensional display are examined. Whether the overlap between the adjacent viewpoint images has adverse effects is determined by whether the overlapping viewpoint images belong to different lobes, which causes a repeated image.

Specifically, the luminance distribution examining unit A110 examines the luminance distribution with respect to the radiation angle, for each viewpoint of the three-dimensional display, based on the luminance value in the radiation angle direction of a light ray radiated from a predetermined measurement point on the three-dimensional display. The lobe detecting unit A120 finds a lobe that causes a repeated image, based on the luminance distribution of light that is examined by the luminance distribution examining unit A110. Here, the "lobe" refers to a predetermined region corresponding to a peak where the luminance distribution with respect to the radiation angle forms a curve including a plurality of peaks and dips. Based on the lobe, the viewing angle property inspecting unit A130 calculates, as a permissible luminance contrast, the ratio between light that has adverse effects and light that does not necessarily have adverse effects, in the luminance distribution examined by the luminance distribution examining unit A110. Then, the viewing angle property inspecting unit A130 inspects the viewing angle property of the three-dimensional display, based on the calculated permissible luminance contrast. In this manner, in a 3D display of such a type as the integral type that is premised on that a plurality of viewpoint images are observed by the same eye, it is possible to provide an apparatus and method for inspecting the viewing angle property with consideration given to the design concept.

In addition, according to the second embodiment, the luminance distribution examining unit A110 measures a luminance in a radiation angle direction of a light ray radiated from a plane (for example, a plane horizontal to the ground when the three-dimensional display is installed vertically to the ground) orthogonal to the display surface of the three-dimensional display. Therefore, luminance measurements can be made in accordance with a usage manner of the three-dimensional display.

With the second embodiment, N kinds of test images are used for the total number of viewpoints N of the three-dimensional display, so that the luminance distribution for each viewpoint of the three-dimensional display can be examined appropriately.

With the second embodiment, a test image n is used in which only a viewpoint image for viewpoint n is illuminated and none of the other viewpoint images are illuminated, so that the luminance distribution for each viewpoint of the three-dimensional display can be examined appropriately.

With the second embodiment, a region belonging to a lobe can be detected appropriately by using Equation (6) above.

With the second embodiment, the threshold Th is adjusted as appropriate based on the design element or optical device configuration of the three-dimensional display, so that the accuracy of detection of a region belonging to a lobe can be improved.

With the second embodiment, the threshold Th is adjusted as appropriate in accordance with the degree of human visual recognition ability, so that the accuracy of detection of a region belonging to a lobe can be improved.

First Alternative Embodiment

Although the suitable second embodiment of the present invention has been described above, it is needless to say that the second embodiment of the present invention is not limited to the foregoing manner. In the foregoing description, the luminance distribution Ln (X, Y, θ) is detected from only one point of position (X, Y) on the display, and the permissible luminance contrast C1 (X, Y, θ) is calculated. As for one point (X, Y), a display central portion (a point at (X, Y)=(W/2, H/2), where the width of the display surface is W and the height is H) is generally employed as a measurement point. The optical properties of the stereoscopic display to be examined may be inspected using the permissible luminance contrast C1 (X, Y, θ) calculated by the measurement at this one point. However, the optical properties of the stereoscopic display may be inspected by examining the luminance distribution Ln (X, Y, θ) at a plurality of measurement points on the display surface, finding the permissible luminance contrast C1 (X, Y, θ) at each of the plurality of positions, and using a plurality of the permissible luminance contrasts C1 (X, Y, θ).

More specifically, the luminance distribution examining unit A110 may perform the luminance measuring process and luminance distribution examining process as described above for a plurality of measurement points of the three-dimensional display. The lobe detecting unit A120 may perform the region detecting process as described above for the plurality of measurement points. The viewing angle property inspecting unit A130 may find a permissible luminance contrast for the plurality of measurement points and inspect the viewing angle property of the three-dimensional display based on the permissible luminance contrasts found for the plurality of measurement points.

Once the permissible luminance contrasts C1 (X, Y, θ) at a plurality of points are found, the optical properties at more points on the display surface can be considered, so that the more accurate properties of the stereoscopic display can be evaluated. Furthermore, when the position of the observer is assumed, it is possible to simulate how the luminance is distributed at a plurality of points of the display, which makes it possible to objectively define a region in which blurring of an image occurs as a result of simultaneously observing viewpoint images belonging to different lobes when the display is observed. Therefore, it is also possible to examine a region in which a natural stereoscopic image can be observed. In such a case, for example, when the display surface of the display is seen from any given observation position, a region in which the permissible luminance contrast calculated for m measurement points Pm {(X1, Y1), (X2, Y2), (Xm, Ym)} at which luminance distributions are examined (for example, a mean value of permissible luminance contrasts at m points) is equal to or greater than a certain value can be determined as a region in which a natural stereoscopic image can be observed.

Second Alternative Embodiment

In the foregoing description of the second embodiment, as shown in FIG. 16 illustrated above, the luminance distribution examining unit A110 examines only the luminance distribution Ln (X, Y, θ) in the horizontal direction to the ground (the YZ plane in the direction on the plane A23 in FIG. 16). However, the present invention is not limited thereto, and the luminance distribution examining unit A110 may further examine the luminance distribution in the direction (the direction of the XZ plane in FIG. 16) of the plane vertical to both of the display surface of the three-dimensional display and the ground. This is because the 3D displays configured to include lenses or barriers on a surface of a flat display panel include not only a 3D display of a type having parallax only in the horizontal direction as illustrated in the foregoing description of the second embodiment but also a type additionally having parallax in the vertical direction as represented by the type called integral photography. When a 3D display of this type additionally having parallax in the vertical direction is a target, the luminance distribution examining unit A110 preferably measures the luminance values in the angle ϕ direction in the vertical direction and examines the luminance distribution Ln (X, Y, θ, ϕ), rather than examining the luminance distribution Ln (X, Y, θ) as described above. Then, in the lobe detecting unit A120 and the viewing angle property inspecting unit A130, a similar process as the process described in the second embodiment is also performed not only for the θ direction but also for the ϕ direction as the angle direction. Accordingly, finally, the permissible luminance contrast C1 (X, Y, θ, ϕ) can be found, and this value of C1 (X, Y, θ, ϕ) can be used to indicate the optical properties of the stereoscopic display.

Third Alternative Embodiment

In the foregoing description of the second embodiment, the permissible luminance contrast is found using the ratio between the total of the luminance distribution belonging to a certain lobe and the total of the luminance distribution not belonging thereto. More specifically, it can be expressed by Equation (7) below.

[Equation 9]

$$C_l(X, Y, \theta) = \frac{\sum_{i \in l} (L_i(X, Y, \theta))}{\sum_{j \notin l} (L_j(X, Y, \theta))} \tag{7}$$

However, the present invention is not limited thereto. The permissible luminance contrast may be found using the ratio between the total of the luminance distribution belonging to a certain lobe and the total of all the luminance distributions, irrespective of whether it belongs to a lobe or not. More specifically, C' expressed by Equation (8) below may be used as the permissible luminance contrast.

[Equation 10]

$$C'_l(X, Y, \theta) = \frac{\sum_{i \in l} (L_i(X, Y, \theta))}{\sum_{1 \le j \le N} (L_j(X, Y, \theta))} \tag{8}$$

Here, Li and Lj are a luminance distribution measured by the luminance distribution examining unit A110, and i∈l indicates that when a test image i is illuminated, the angle θ at a point (X, Y) on the surface of the display is included in a lobe 1. On the other hand, the denominator in the equation is the total of the results of measuring all the test images 1 to N. The possible numeric value of the permissible luminance contrast can be set to be a value from zero or more to one or less by calculating the permissible luminance contrast by such an equation, so that the properties of displays having different properties can be compared with each other more easily.

REFERENCE SIGNS LIST

1 . . . optical property evaluation apparatus, 10 . . . luminance measuring unit, 20 . . . luminance distribution analyzing unit, 30 . . . interocular luminance analyzing unit, 40 . . . stereoscopy determining unit, 58 . . . luminance meter, 60 . . . 3D display, 61 . . . measurement point, 62 . . . display surface, 70 . . . observer, 71 . . . right eye, 72 . . . left eye, 80, 81, 82 . . . luminance distribution image, 91, 92, 91 . . . stereoscopy determination image.

A1 . . . viewing angle property inspection apparatus, A110 . . . luminance distribution examining unit, A120 . . . lobe detecting unit, A130 . . . viewing angle property inspecting unit, A18 . . . luminance meter, A20 . . . display, A21 . . . measurement point, A22 . . . display surface of the display A20.

The invention claimed is:

1. An apparatus for evaluating optical properties of a three-dimensional display, the apparatus comprising:

a luminance measuring unit configured to measure luminance in a radiation angle direction of a light ray radiated from a predetermined measurement point on the three-dimensional display;

a luminance distribution analyzing unit configured to analyze a luminance distribution state in the radiation angle direction of the light ray based on luminance data measured by the luminance measuring unit, and to generate a luminance distribution image of the light ray, the luminance distribution image being an image that shows luminance distribution of the light ray in a region between the three-dimensional display and an observer;

an interocular luminance analyzing unit configured to analyze luminance perceived between eyes of the observer based on the luminance distribution image, and to generate a stereoscopy determination image; and a stereoscopy determining unit configured to determine a certain region in the radiation angle direction in front of the three-dimensional display, as a stereoscopy possible region, based on the stereoscopy determination image.

2. The apparatus for evaluating optical properties of the three-dimensional display according to claim 1, wherein the luminance distribution analyzing unit is configured to analyze the luminance distribution state for each viewpoint and to generate a corresponding luminance distribution image for each viewpoint of the three-dimensional display.

3. The apparatus for evaluating optical properties of the three-dimensional display according to claim 2, wherein the interocular luminance analyzing unit is configured to extract two luminance distribution images corresponding to an interocular distance of the observer, from among the corresponding luminance distribution image for each viewpoint that are generated by the luminance distribution analyzing unit, and to analyze a contrast ratio of luminance between the eyes of the observer using the extracted two luminance distribution images, thereby generating the stereoscopy determination image.

4. The apparatus for evaluating optical properties of the three-dimensional display according to claim 1, wherein the luminance distribution analyzing unit is configured to analyze the luminance distribution state for each line-of-sight direction and to generate a corresponding luminance distribution image for each line-of-sight direction of the three-dimensional display.

5. The apparatus for evaluating optical properties of the three-dimensional display according to claim 4, wherein the interocular luminance analyzing unit is configured to extract two luminance distribution images corresponding to an interocular distance of the observer, from among the corresponding luminance distribution image for each line-of-sight direction that are generated by the luminance distribution analyzing unit, and to analyze a contrast ratio of luminance between the eyes of the observer using the extracted two luminance distribution images, thereby generating the stereoscopy determination image.

6. The apparatus for evaluating optical properties of the three-dimensional display according to claim 3, wherein the contrast ratio of luminance is a ratio between light that should enter and light that should not enter a right eye and a left eye of the observer.

7. The apparatus for evaluating optical properties of the three-dimensional display according to claim 5, wherein the contrast ratio of luminance is a ratio between light that should enter and light that should not enter a right eye and a left eye of the observer.

8. The apparatus for evaluating optical properties of the three-dimensional display according to claim 6, wherein a value of the contrast ratio of luminance does not entail a sign change when light that should enter the right eye of the observer enters the right eye and light that should enter the left eye of the observer enters the left eye, whereas the value entails a sign change when light that should enter the right eye of the observer enters the left eye of the observer or when light that should enter the left eye of the observer enters the right eye of the observer.

9. The apparatus for evaluating optical properties of the three-dimensional display according to claim 7, wherein a value of the contrast ratio of luminance does not entail a sign change when light that should enter the right eye of the observer enters the right eye and light that should enter the left eye of the observer enters the left eye, whereas the value entails a sign change when light that should enter the right eye of the observer enters the left eye of the observer or when light that should enter the left eye of the observer enters the right eye of the observer.

10. The apparatus for evaluating optical properties of the three-dimensional display according to claim 6, wherein the stereoscopy determining unit is configured to determine the certain region that corresponds to a portion in which the contrast ratio of luminance exceeds a predetermined threshold in the stereoscopy determination image, as the stereoscopy possible region.

11. The apparatus for evaluating optical properties of the three-dimensional display according to claim 7, wherein the stereoscopy determining unit is configured to determine the certain region that corresponds to a portion in which the contrast ratio of luminance exceeds a predetermined threshold in the stereoscopy determination image, as the stereoscopy possible region.

12. The apparatus for evaluating optical properties of the three-dimensional display according to claim 8, wherein the stereoscopy determining unit is configured to determine the certain region that corresponds to a portion in which the contrast ratio of luminance exceeds a predetermined threshold in the stereoscopy determination image, as the stereoscopy possible region.

13. The apparatus for evaluating optical properties of the three-dimensional display according to claim 9, wherein the stereoscopy determining unit is configured to determine the certain region that corresponds to a portion in which the contrast ratio of luminance exceeds a predetermined threshold in the stereoscopy determination image, as the stereoscopy possible region.

14. The apparatus for evaluating optical properties of the three-dimensional display according to claim 1, wherein the luminance distribution image and the stereoscopy determination image are images indicating the luminance distribution in the region on a plane orthogonal to a display surface of the three-dimensional display.

15. A method for evaluating optical properties of a three-dimensional display, the method comprising:

measuring, by a luminance measuring unit, luminance in a radiation angle direction of a light ray radiated from a predetermined measurement point on the three-dimensional display;

analyzing, by a luminance distribution analyzing unit, a luminance distribution state in the radiation angle direction of the light ray based on luminance data measured by the luminance measuring unit, and generating a luminance distribution image of the light ray, the luminance distribution image being an image that shows luminance distribution of the light ray in a region between the three-dimensional display and an observer;

analyzing, by an interocular luminance analyzing unit, luminance perceived between eyes of the observe based on the luminance distribution image, and generating a stereoscopy determination image; and determining, by a stereoscopy determining unit, a certain region in the radiation angle direction in front of the three-dimensional display, as a stereoscopy possible region, based on the stereoscopy determination image.

16. The apparatus for evaluating optical properties of the three-dimensional display according to claim 1, wherein the stereoscopy determination image is another image that shows luminance contrast between the eyes of the observer in the certain region between the three-dimensional display and the observer.

17. The apparatus for evaluating optical properties of the three-dimensional display according to claim 1, wherein the luminance distribution image includes a white portion and a black portion, and the white portion indicates a high luminance portion and the black portion indicates a low luminance portion.

18. The apparatus for evaluating optical properties of the three-dimensional display according to claim 1, wherein the stereoscopy determination image includes a white portion and a black portion, and the white portion indicates a high luminance contrast portion and the black portion indicates a low luminance contrast portion.

19. The apparatus for evaluating optical properties of the three-dimensional display according to claim 1, wherein the stereoscopy determination image is another image indicating luminance contrast on a two-dimensional plane across a central horizontal plane of the three-dimensional display.

* * * * *